US012435629B2

(12) United States Patent
Sekiyama et al.

(10) Patent No.: US 12,435,629 B2
(45) Date of Patent: Oct. 7, 2025

(54) TUNNEL EXCAVATION DEVICE

(71) Applicant: KOMATSU LTD., Tokyo (JP)

(72) Inventors: Naoki Sekiyama, Tokyo (JP); Taku Arakawa, Tokyo (JP); Hiroshi Asano, Tokyo (JP); Shinichi Terada, Tokyo (JP); Eiichi Morioka, Tokyo (JP)

(73) Assignee: KOMATSU LTD., Tokyo (JP)

( * ) Notice: Subject to any disclaimer, the term of this patent is extended or adjusted under 35 U.S.C. 154(b) by 218 days.

(21) Appl. No.: 17/909,848

(22) PCT Filed: Feb. 26, 2021

(86) PCT No.: PCT/JP2021/007234

§ 371 (c)(1),
(2) Date: Sep. 7, 2022

(87) PCT Pub. No.: WO2021/192806

PCT Pub. Date: Sep. 30, 2021

(65) Prior Publication Data

US 2024/0200448 A1 Jun. 20, 2024

(30) Foreign Application Priority Data

Mar. 27, 2020 (JP) ..... 2020-058000

(51) Int. Cl.
*E21D 9/10* (2006.01)
*E21D 9/06* (2006.01)
*E21D 9/11* (2006.01)

(52) U.S. Cl.
CPC ..... *E21D 9/06* (2013.01); *E21D 9/112* (2013.01); *E21D 9/10* (2013.01)

(58) Field of Classification Search
CPC .... E21D 9/06; E21D 9/08; E21D 9/10; E21D 9/1093; E21D 9/112
See application file for complete search history.

(56) References Cited

U.S. PATENT DOCUMENTS 3,345,108 A * 10/1967 Newman ..... E21D 9/1093 299/31
3,713,700 A 1/1973 Montacie
(Continued)

FOREIGN PATENT DOCUMENTS

CN 1140790 A 1/1997
CN 208168883 U 11/2018
(Continued)

OTHER PUBLICATIONS

The Examination report No. 1 for the corresponding Australian application No. 2021242898, dated Sep. 13, 2023.
(Continued)

*Primary Examiner* — Sunil Singh
(74) *Attorney, Agent, or Firm* — GLOBAL IP COUNSELORS, LLP

(57) ABSTRACT

A tunnel excavation device includes a front body section and a rear body section. The front body section includes a cutter head, a cutter head support, peripheral plates, a roof shoe, and side shoes. The cutter head includes a plurality of roller cutters. The cutter head support supports the cutter head. The peripheral plates, the roof shoe, and the side shoes are provided to the outer circumference and can be collapsed inward. The rear body section is disposed to the rear of the front body section. The rear body section includes a gripper section. The gripper section obtains a reaction force for performing excavation.

19 Claims, 33 Drawing Sheets

(56) References Cited

U.S. PATENT DOCUMENTS

| | | | | |
|---|---|---|---|---|
| 4,494,799 | A * | 1/1985 | Snyder | E21D 9/12 299/56 |
| 5,890,771 | A | 4/1999 | Cass | |

FOREIGN PATENT DOCUMENTS

| | | | |
|---|---|---|---|
| JP | 9-221983 | A | 8/1997 |
| JP | 10-220181 | A | 8/1998 |
| JP | 11-36776 | A | 2/1999 |
| JP | 2001-241294 | A | 9/2001 |
| JP | 2002-47891 | A | 2/2002 |
| JP | 2005-120651 | A | 5/2005 |
| JP | 2005-188210 | A | 7/2005 |
| JP | 4371603 | B2 | 9/2009 |

OTHER PUBLICATIONS

The International Search Report for the corresponding international application No. PCT/JP2021/007234, issued on May 18, 2021.
The Office Action for the corresponding Chinese application No. 202180013127.5 issued on Sep. 13, 2024.

* cited by examiner

TUNNEL EXCAVATION DEVICE

CROSS-REFERENCE TO RELATED APPLICATIONS

This application is a U.S. National stage application of International Application No. PCT/JP2021/007234, filed on Feb. 26, 2021. This U.S. National stage application claims priority under 35 U.S.C. § 119(a) to Japanese Patent Application No. 2020-058000, filed in Japan on Mar. 27, 2020, the entire contents of which are hereby incorporated herein by reference.

TECHNICAL FIELD

The present disclosure relates to a tunnel excavation device used when excavating a tunnel.

BACKGROUND INFORMATION

Conventionally, a tunnel excavation device is used for excavating rock in civil engineering work. The tunnel excavation device comprises a cutter head that includes cutters on the machine front surface, and gripper devices provided on the left and right side surfaces of a machine rear section (for example, see Japanese Laid-open Patent H10-220181).

In such a tunnel excavation device, the tunnel is excavated by extending a thrust cylinder while rotating the cutter head and pressing the cutter head against the rock while the left and right gripper devices are pressed against the tunnel left and right side walls.

SUMMARY

However, work only advances forward in civil engineering work and a conventional tunnel excavation device cannot be used in a pit mine which requires reverse travel.

For example, when concrete or mortar is sprayed onto the inside walls of an excavated tunnel and timbering support is installed, the tunnel inner diameter becomes smaller than the inner diameter during excavation. As a result, the tunnel excavation device is blocked by the tunnel inside walls and cannot travel in reverse.

In addition, because it is thought that curved line construction is performed when forming a pit mine, there is a need to travel in reverse in a curved line in addition to traveling in a straight line when traveling in reverse. When traveling in reverse along a curved line, it is possible that the device could be blocked by the tunnel inside wall and would not be able to travel in reverse even when, for example, the tunnel inner diameter is not reduced.

An object of the present disclosure is to provide a tunnel excavation device that can travel in reverse.

Means for Resolving the Problem

A tunnel excavation device according to the present disclosure includes a front body section and a rear body section. The front body section includes a cutter head, a cutter head support section, and a collapsing section. The cutter head includes a plurality of cutters. The cutter head support section supports the cutter head. The collapsing section is provided to the outer circumference and is able to collapse inward. The rear body section includes a gripper section. The gripper section obtains a reaction force for performing excavation. The rear body section is disposed to the rear of the front body section.

According to the present disclosure, it is possible to provide a tunnel excavation device that is capable of traveling in reverse.

DESCRIPTION OF EMBODIMENTS

A tunnel excavation device of an embodiment according to the present disclosure will be explained with reference to the drawings.

The tunnel excavation device of the present embodiment is a so-called gripper tunnel boring machine (TBM) type or a hard rock TBM type of TBM (Tunnel Boring Machine). The tunnel excavation device of the present embodiment can be used in pit mining for mines and not only for construction work.

(Overall Configuration of Tunnel Excavation Device)

Figure 1A:
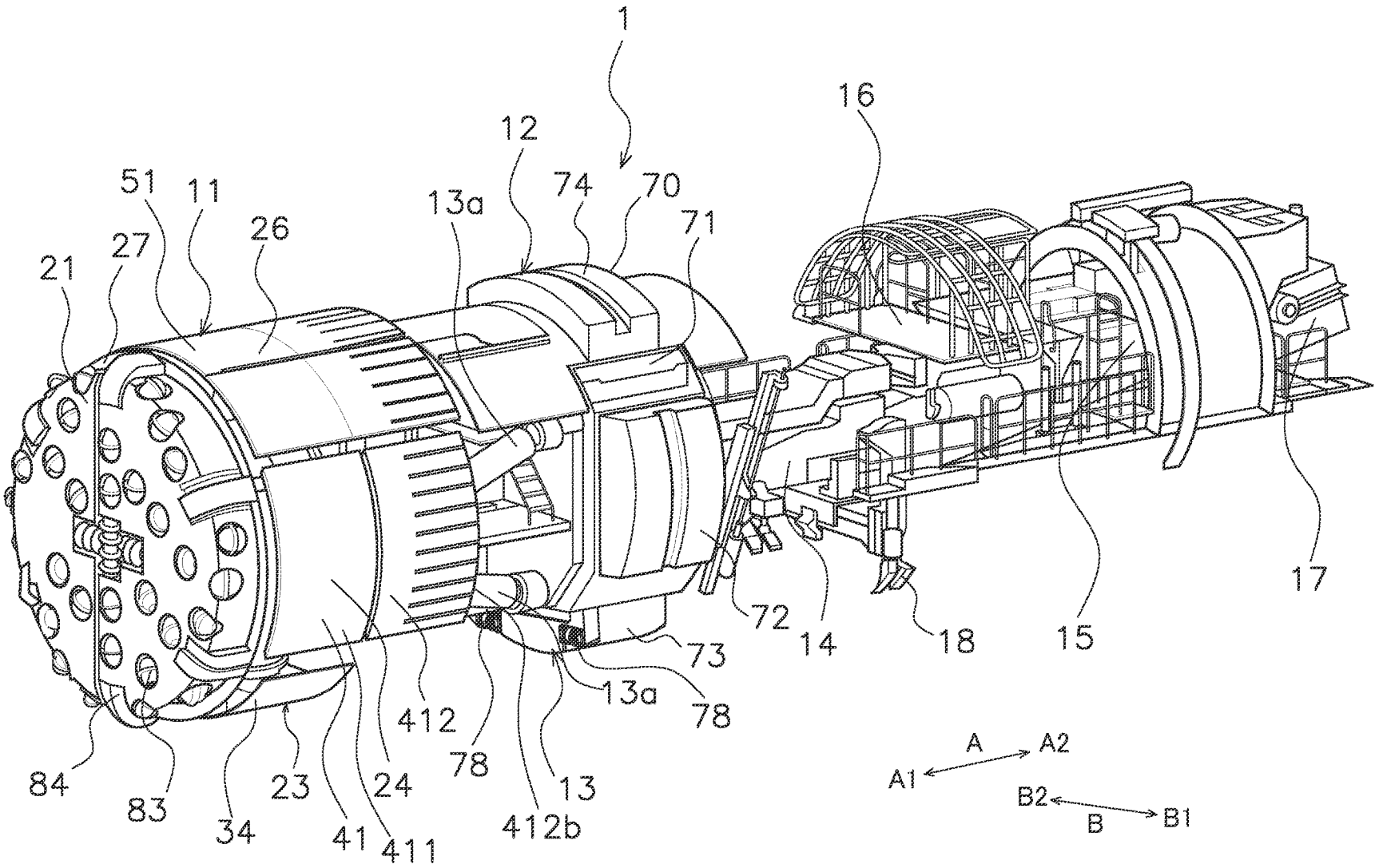
FIG. 1A is a perspective view illustrating a tunnel excavation device according to an embodiment of the present disclosure.
Figure 1B:
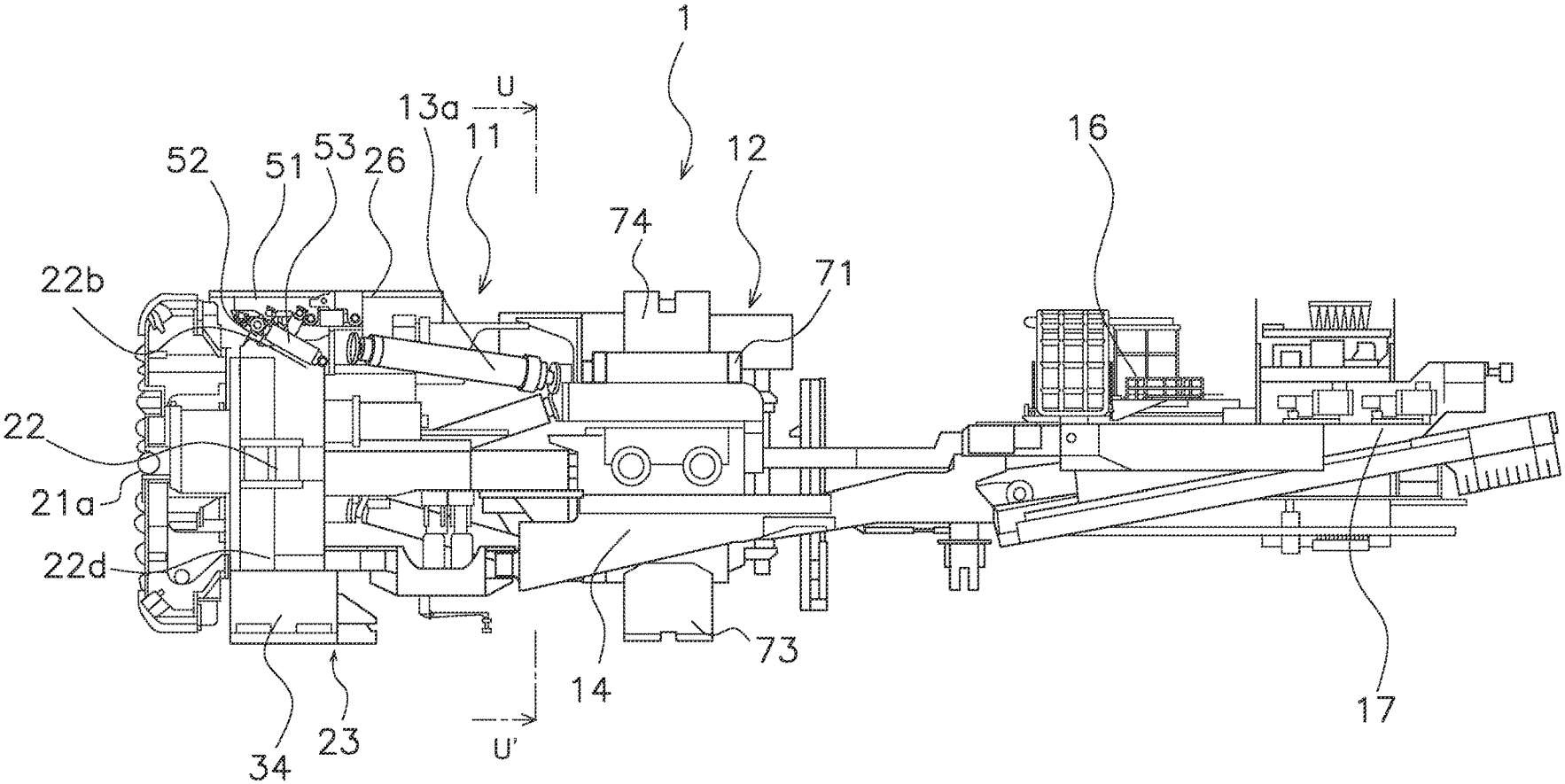
FIG. 1B is a side cross-sectional view illustrating an internal configuration of the tunnel excavation device in FIG. 1A.

FIG. 1A is a perspective view illustrating a tunnel excavation device 1 of the present embodiment. FIG. 1B is a side cross-sectional view of FIG. 1A.

The tunnel excavation device 1 of the present embodiment causes a cutter head 21 to rotate to perform excavating while being supported on the inner walls of the tunnel with a gripper section 70.

The tunnel excavation device 1 of the present embodiment has a front body section 11, a rear body section 12, a connecting section 13, a main beam 14, a frame 15, a work platform 16, a belt conveyor 17, and a rear support 18.

The front body section 11 has the cutter head 21 at the front end, as illustrated in FIG. 1A, and excavates rock. The rear body section 12 is disposed on the rear side of the front body section 11 and can be supported on the tunnel inner walls with the gripper section 70. In the drawings, the front-back direction is indicated by A, the forward direction is indicated by arrow A1 and the rearward direction is indicated by arrow A2. The arrow A indicates the front-back direction while the front body section 11 is not bent with respect to the rear body section 12 and is disposed in a straight line. The arrow B in the drawings indicates the width direction and is a direction perpendicular to the front-back direction A and horizontal. Within the width direction B, the leftward direction when facing in the forward direction A1 is indicated by B1 and the rightward direction when facing in the forward direction A1 is indicated by B2.

The connecting section 13 connects the front body section 11 and the rear body section 12 in a bendable manner. The connecting section 13 has a plurality of thrust cylinders 13*a*, and one end of each thrust cylinder 13*a* is turnably connected to the front body section 11 and the other end of each thrust cylinder 13*a* is turnably connected to the rear body section 12.

Figure 1C:
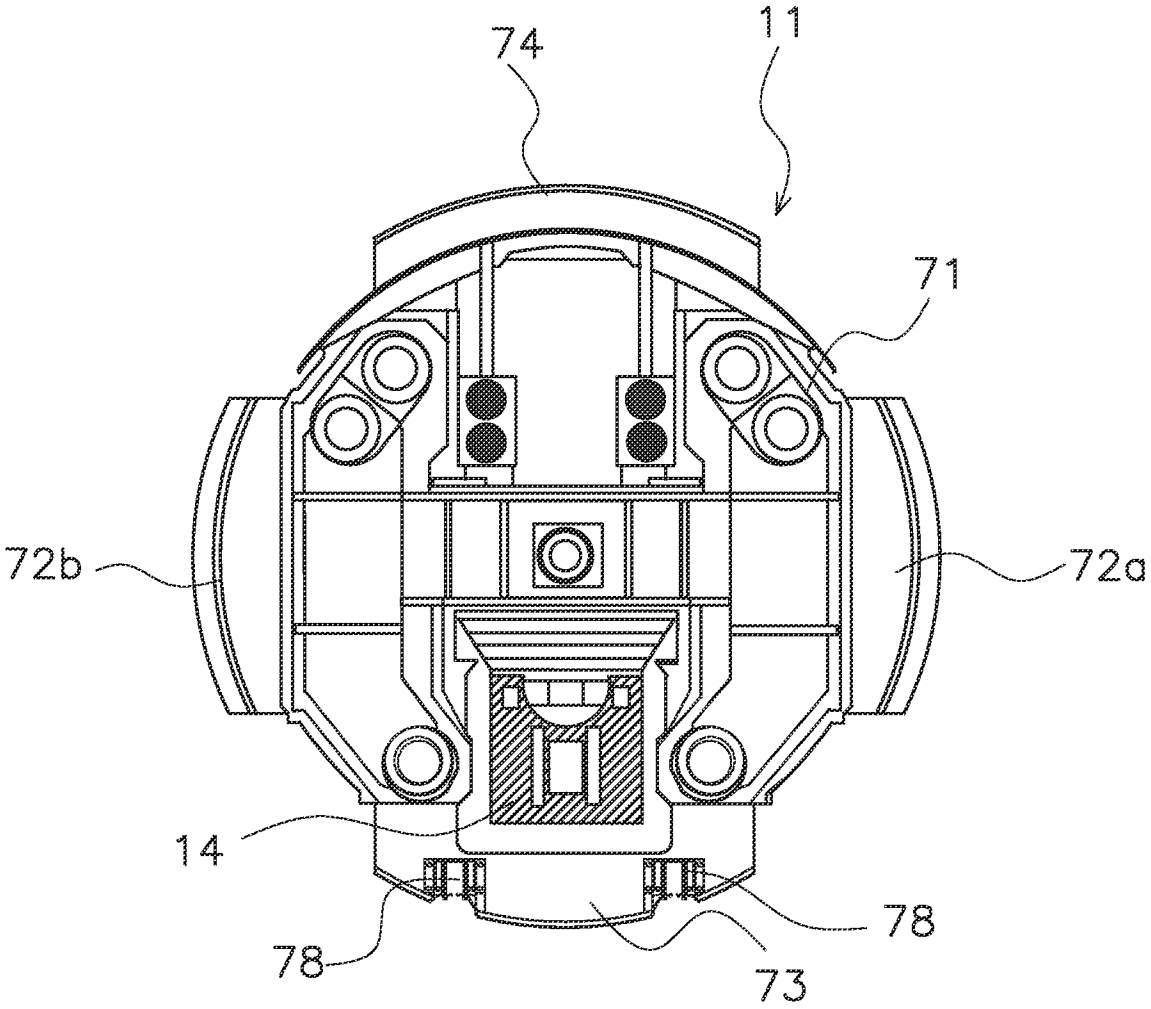
FIG. 1C is a diagram that illustrates a main beam and the rear body section along arrows U and U' in FIG. 1B.

FIG. 1C is a diagram illustrating the main beam 14 and the rear body section 12 along arrows U and U' in FIG. 1B. As illustrated in FIGS. 1B and 1C, the main beam 14 is connected to the front body section 11 by a turnable coupling member and supports the rear body section 12 in a manner that allows sliding forward and backward in the A direction. The main beam 14 extends from the rear body section 12 toward the rear. The frame 15 is turnably attached to the rear end of the main beam 14. The work platform 16 is provided for performing work for spreading netting onto the tunnel inner walls after the excavation, and is disposed above the frame 15.

The conveyor belt 17 is provided from the front body section 11 through the rear body section 12 to the lower side of the frame 15 and conveys rock and sand excavated by the cutter head 21 to the rear.

The rear support 18 is provided to the main beam 14 and supports the main beam 14 when the rear body section 12 is traveling forward.

Although not indicated in the drawings, a vehicle provided with a control device, a power supply device, and a hydraulic system and the like for driving the cutter head 21, the conveyor belt 17, the plurality of thrust cylinders 13*a*, and the gripper section 70 and the like is joined to the rear of the frame 15.

(Front Body Section 11)

Figure 2:
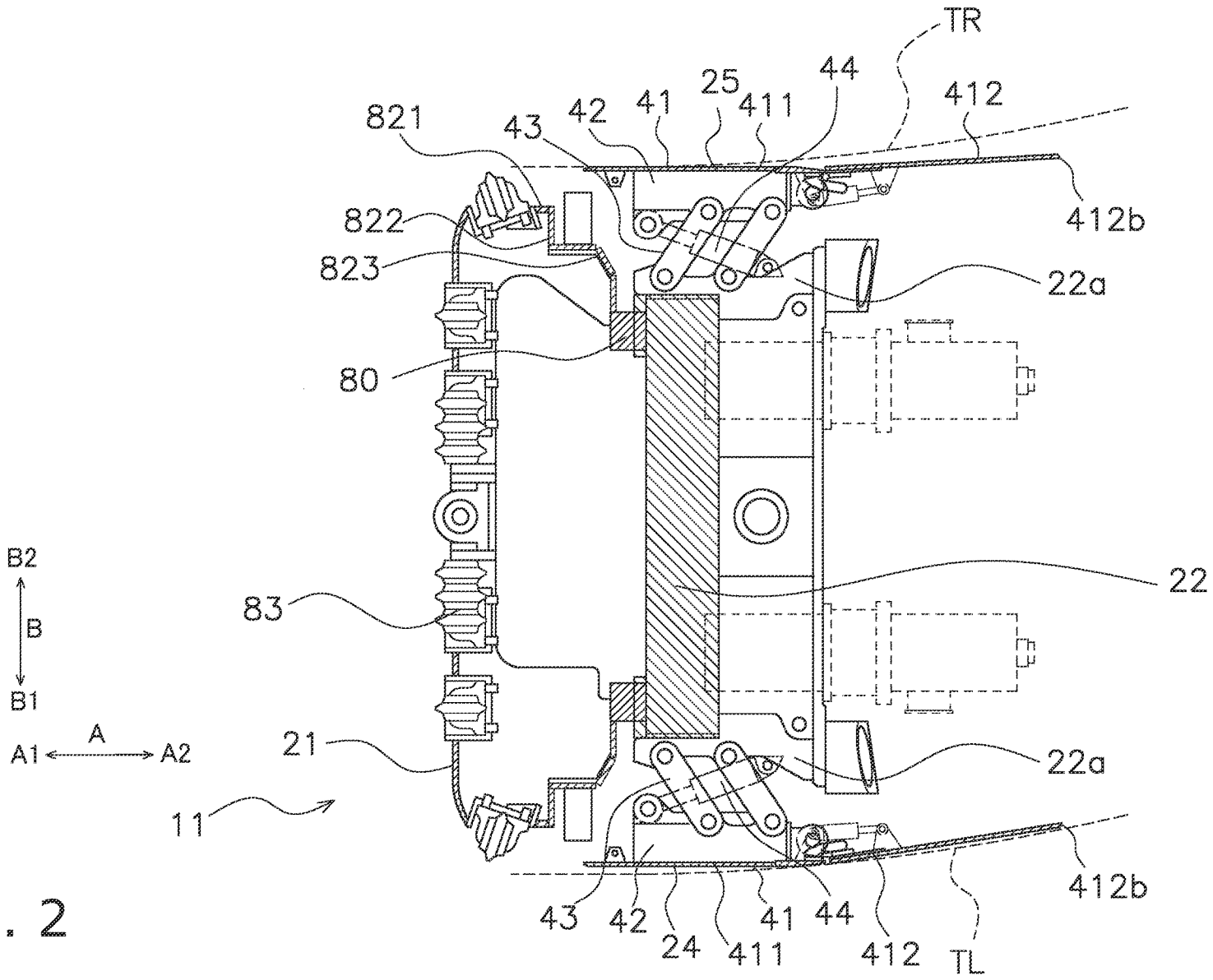
FIG. 2 is a plan cross-sectional view illustrating the front body section of the tunnel excavation device in FIG. 1A.

FIG. 2 is a schematic view of a plan cross-section illustrating a configuration of the front body section 11.

The front body section 11 has the cutter head 21, a cutter head support 22 (example of a cutter head support section), a vertical support 23, side supports 24 and 25, a roof support 26, and a plurality of peripheral plates 27.

The cutter head 21 is provided to the front end of the front body section 11 and is provided so as to be able to rotate with respect to the cutter head support 22. As illustrated in FIG. 1A, the cutter head 21 has a plurality of roller cutters 83 provided to the excavation-side surface and buckets 84 for taking in the excavated rock the inside of the cutter head 21.

The cutter head support 22 is disposed to the rear of the cutter head 21. The cutter head support 22 rotatably supports the cutter head 21.

The vertical support 23, the pair of side supports 24 and 25, and the roof support 26 are attached to the cutter head support 22 and are disposed so as to encircle the circumference of the cutter head support 22. The vertical support 23, the pair of side supports 24 and 25, and the roof support 26 are provided for supporting the cutter head support 22 against the tunnel side wall for stabilization during excavation and for protecting the cutter head support 22 from rock slides from the side wall.

The vertical support 23 is disposed below the cutter head support 22. The pair of side supports 24 and 25 are disposed on either side in the width direction of the cutter head support 22. The roof support 26 is disposed above the cutter head support 22.

The plurality of peripheral plates 27 are disposed in the circumferential direction of the front body section 11 in order to block the movement of dust produced during the excavation from the front body section 11 to the rear body section 12.

(Cutter Head 21)

Figure 3B:
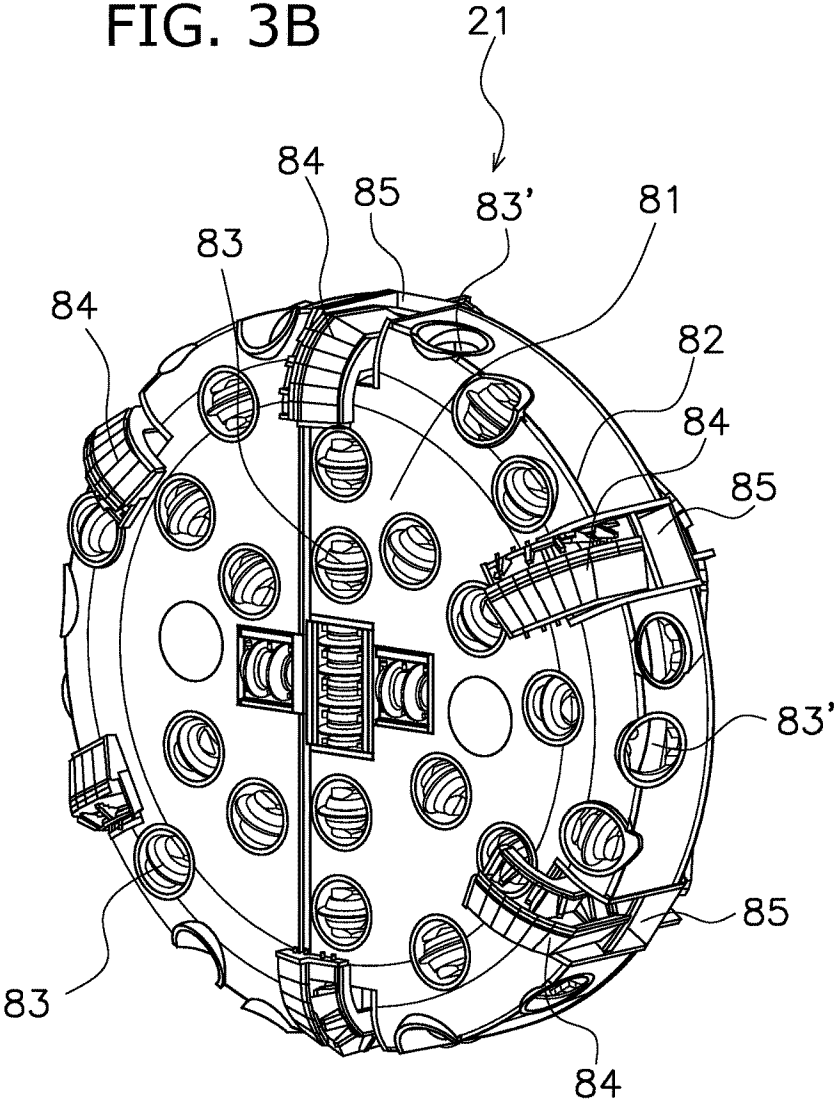
FIG. 3B is a perspective view illustrating a reduced diameter state of the cutter head in FIG. 3A.
Figure 3A:
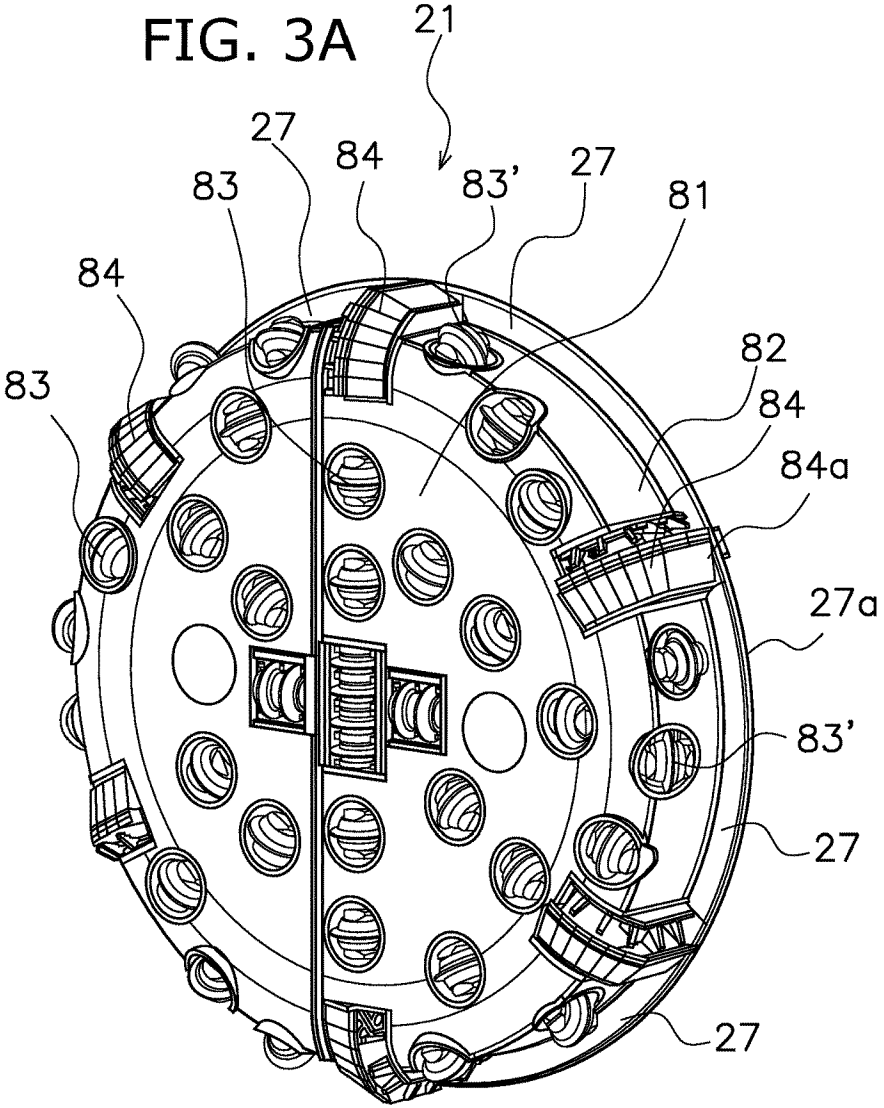
FIG. 3A is a perspective view illustrating the cutter head in FIG. 1A.

FIG. 3A is a perspective view illustrating the cutter head 21. FIG. 3B is a perspective view illustrating the cutter head 21 in a below-mentioned reduced diameter state.

The cutter head 21 is rotatably supported by the cutter head support 22.

The cutter head 21 has a front surface section 81, a side surface section 82, the roller cutters 83, and the buckets 84.

The front surface section 81 is a surface on the excavating side and is formed in a circular shape as seen from the front. The side surface section 82 has a tubular shape and is formed from the outer circumferential end of the front surface section 81 toward the rear. The side surface section 82 has an outer surface 821, a rear surface 822, and a connection surface 823 as illustrated in FIG. 2.

The outer surface 821 is provided so as to extend from the outer circumferential end of the front surface section 81 in the rearward direction A2. The rear surface 822 is provided so as to extend from the rear end of the outer surface 821 toward the inside in the radial direction. The connection surface 823 has a portion that extends from the radially inward end of the rear surface 822 in the rearward direction A2 and a portion that extends from the rear end of the extending portion toward the inside in the radial direction in the position of the cross-sectional view of FIG. 2. The connection surface 823 is connected to a coupling section 80 of the cutter head support 22.

The roller cutters 83 are provided on the front surface section 81 and the side surface section 82. The roller cutters 83 also rotate with the rotation of the cutter head 21 to excavate the rock.

The buckets 84 scoop up the rock and sand excavated by the roller cutters 83 following the rotation of the cutter head 21 and move to the belt conveyor 17 disposed to the rear of the front surface section 81.

(Buckets 84)

Figure 4:
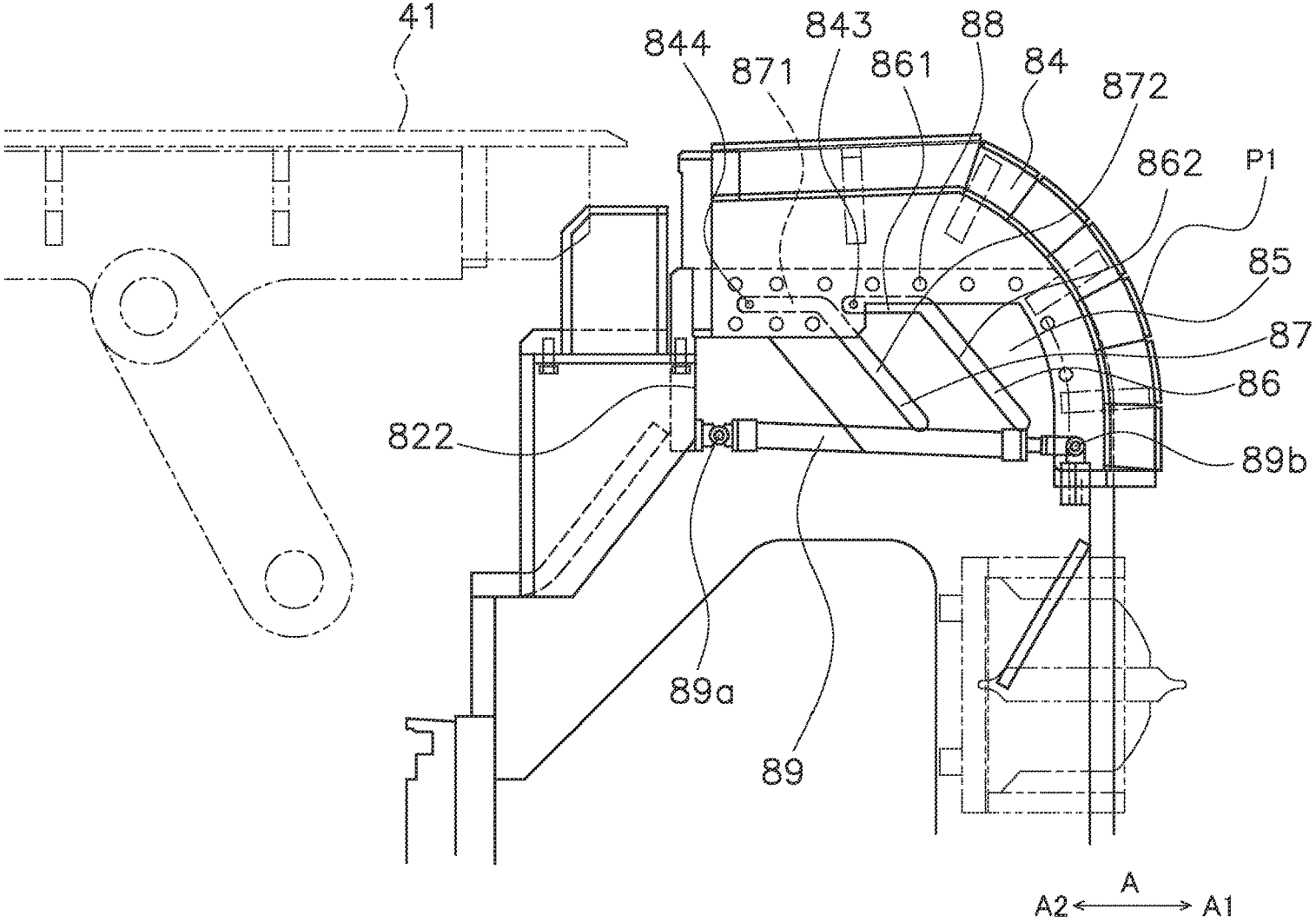
FIG. 4 is a side view illustrating a state in which a bucket of FIG. 3 is disposed in an excavating position.
Figure 5:
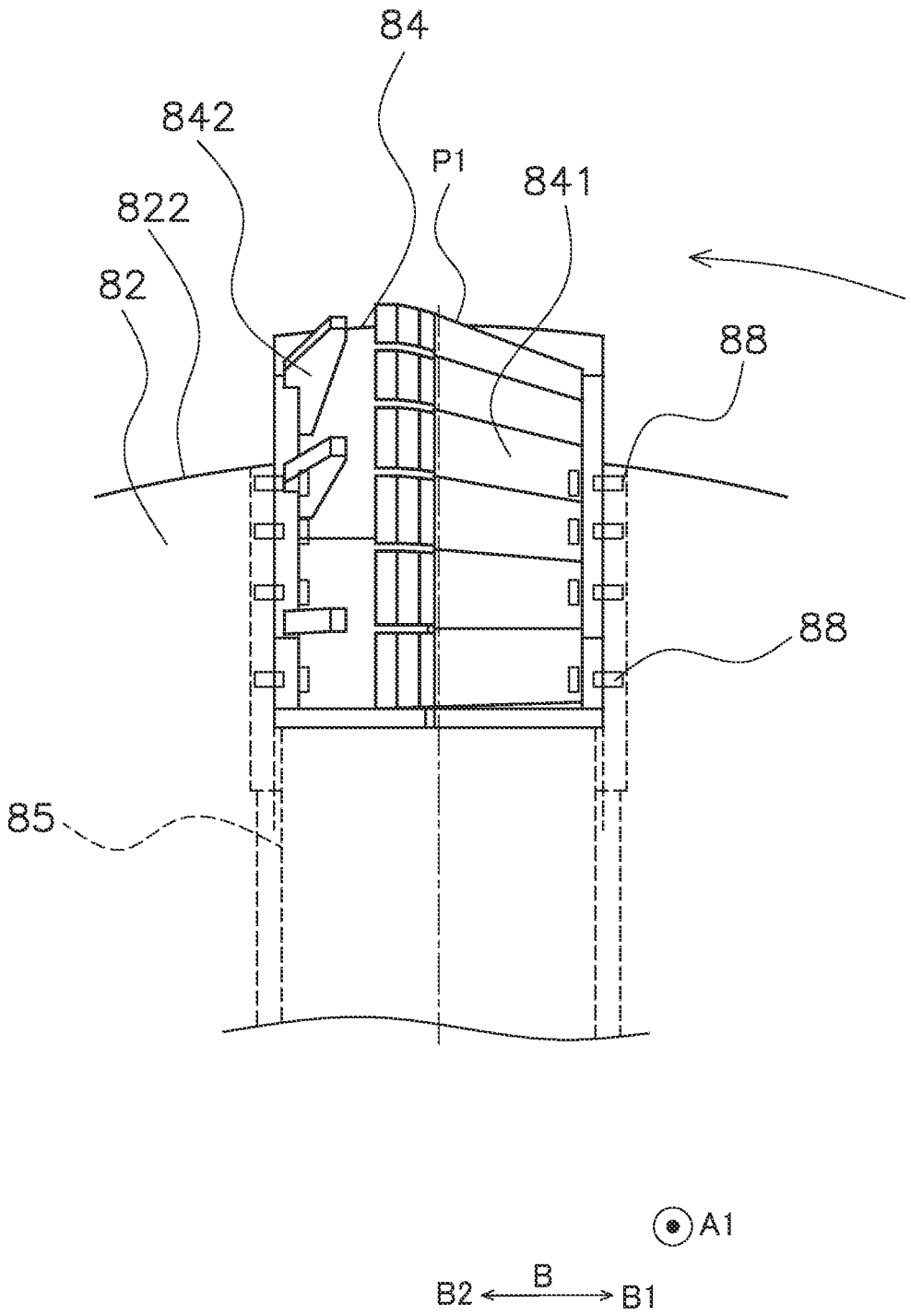
FIG. 5 is a front view illustrating a state in which the bucket of FIG. 3 is disposed in the excavating position.

FIG. 4 is a side view illustrating the bucket 84. FIG. 5 is a front view illustrating the bucket 84.

The buckets 84 are provided to the front surface section 81 as illustrated in FIG. 3A. The buckets 84 are disposed from near the outer circumferential edge of the front surface section 81 across the side surface section 82 as illustrated in FIGS. 3A and 4. In the present embodiment, six buckets 84 are disposed in equal intervals in the circumferential direction.

The buckets 84 protrude further to the outside than the outer surface 821 of the side surface section 82 as illustrated in FIG. 5. As illustrated in FIG. 3A, the positions of outer circumferential ends 84*a* of the buckets 84 roughly match the positions in the radial direction of outer circumferential ends 27*a* of the below-mentioned peripheral plates 27.

The buckets 84 have scraper sections 841 for scooping up sand and stone as illustrated in FIG. 5. The scraper sections 841 are provided in the radial direction on the end opposite to the rotating direction (see arrow in FIG. 5) of the cutter head 21. The buckets 84 also have a plurality of protrusions 842 that face the scraper sections 841. The radial direction is a direction perpendicular to the center axis of the circular front surface section 81 as seen from the front and is a direction going toward or going away from the center axis.

As illustrated in FIG. 3B, attachment sections 85 for attaching the buckets 84 are provided to the front surface section 81.

The attachment sections 85 are formed in groove shapes from the outer edge of the front surface section 81 across the side surface section 82 as illustrated in FIG. 3B. The buckets 84 are disposed in the attachment sections 85 and are fixed by a plurality of bolts 88.

In addition, the buckets 84 are configured to be able to move so as to sink into the outer diameter of the side surface section 82 in order to reduce the outer diameter of the front body section 11 when the tunnel excavation device 1 is made to travel in reverse. The state in which the buckets 84 have moved is depicted in FIG. 3B.

As illustrated in FIG. 4, guide grooves 86 and 87 are formed in the attachment sections 85 to allow the buckets 84 to move from an excavating position P1 when excavating to a storage position P2 on the inside.

The guide groove 86 has a first portion 861 and a second portion 862. The first portion 861 is formed along the front-back direction A. The second portion 862 is formed from the front end of the first portion 861. The second portion 862 is inclined so as to be positioned further to the inside while facing in the forward direction A1.

The guide groove 87 has a first portion 871 and a second portion 872. The first portion 871 is formed along the front-back direction A. The second portion 872 is formed from the front end of the first portion 871. The second portion 872 is inclined so as to be positioned further to the inside while facing in the forward direction A1.

The guide groove 86 is provided on the front side of the guide groove 87. The first portion 861 is disposed in a straight line with the first portion 871. The second portion 862 is formed parallel to the second portion 872.

Two fitting pins 843 and 844 that respectively fit to the guide groove 86 and the guide groove 87 are provided to each bucket 84. The two fitting pins 843 and 844 are disposed in a line in the front-back direction A. While the buckets 84 are disposed in the excavating position P1, the front fitting pin 843 is disposed in the first portion 861 of the guide groove 86, and the rear fitting pin 844 is disposed in the first portion 871 of the guide groove 87.

When the buckets 84 move from the excavating position P1 to the storage position P2, a storage hydraulic cylinder 89 is brought to the inside of the attachment section 85 as illustrated in FIG. 4. One end 89*a* of the storage hydraulic cylinder 89 is turnably attached to the rear surface 822. The other end 89*b* of the storage hydraulic cylinder 89 is turnably attached near to the front end of each bucket 84.

Next, the plurality of bolts 88 for fixing the buckets 84 to the attachment sections 85 are removed.

Figure 6:
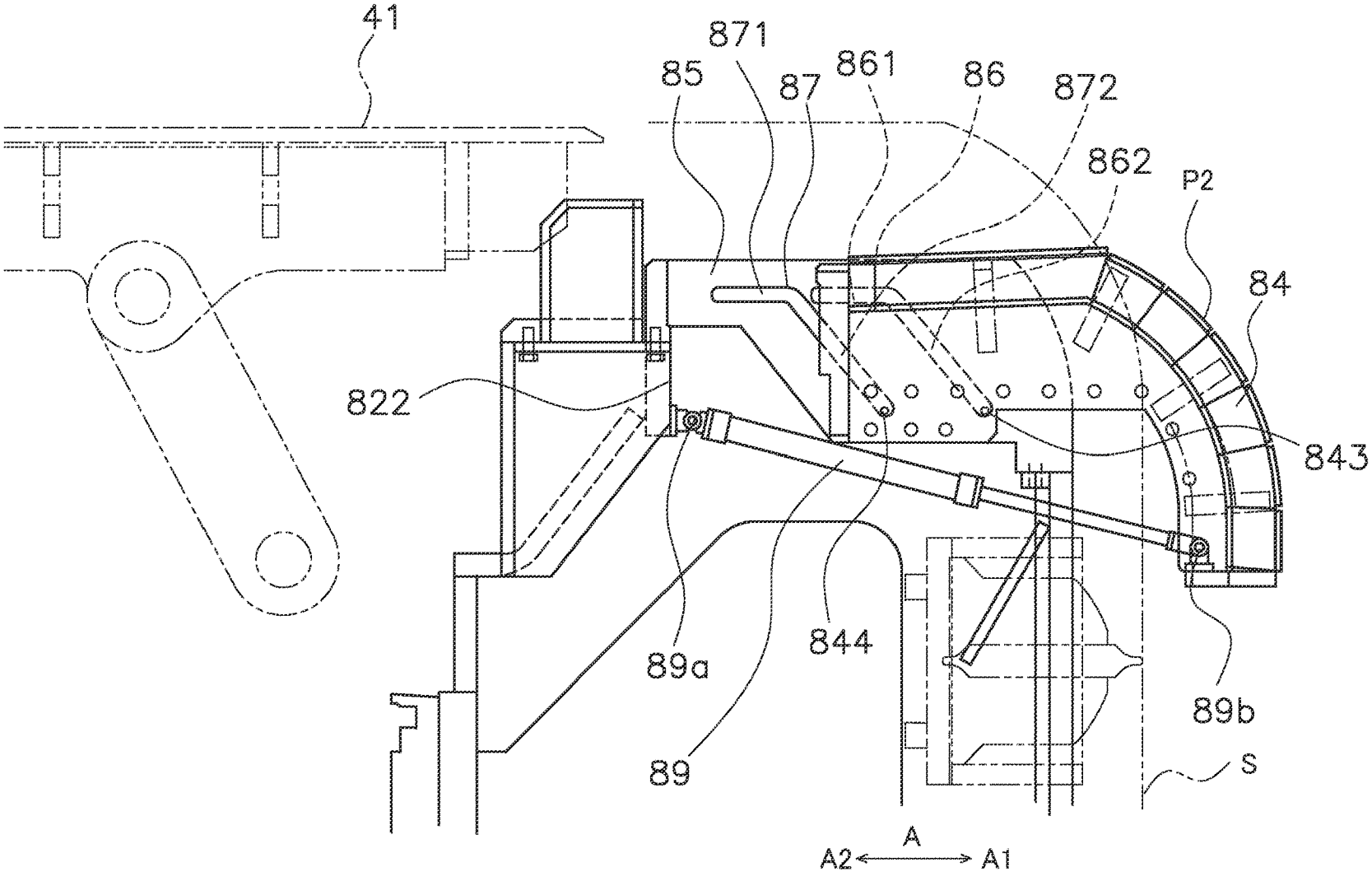
FIG. 6 is a side view illustrating a state in which a bucket of FIG. 3 is disposed in a storage position.
Figure 7:
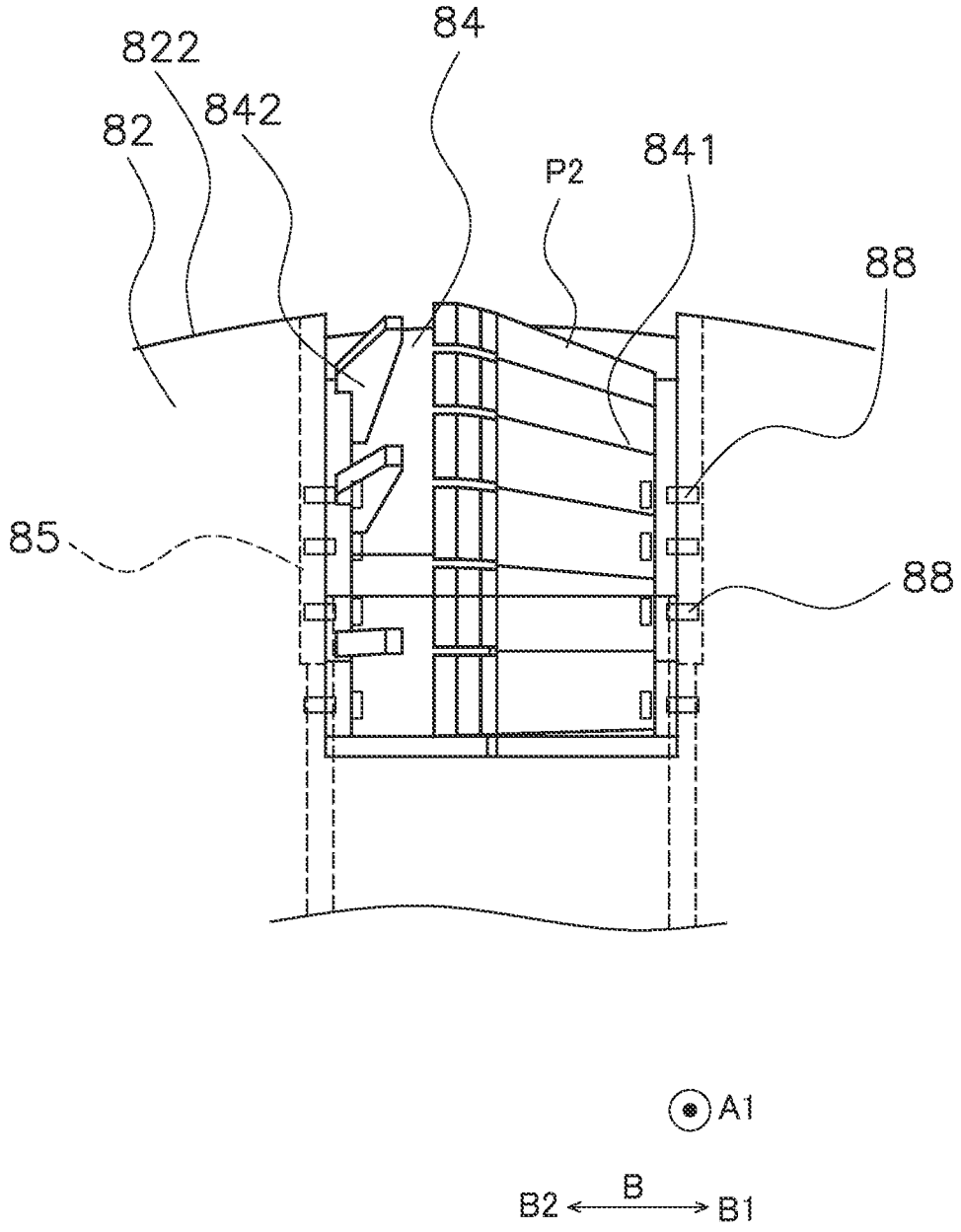
FIG. 7 is a front view illustrating a state in which the bucket of FIG. 3 is disposed in the storage position.

Next, when the storage hydraulic cylinder 89 is extended, the front fitting pin 843 moves from the first portion 861 to the second portion 862 of the guide groove 86, and the rear fitting pin 844 moves from the first portion 871 to the second portion 872 of the guide groove 87. As a result, the buckets 84 move forward toward the inside along the guide grooves 86 and 87 as illustrated in FIG. 6. FIG. 6 is a side view illustrating a state in which the buckets 84 have moved to the storage position P2. FIG. 7 is a front view illustrating the state in which the buckets 84 have moved to the storage position P2.

After moving, the buckets 84 are fixed to the attachment sections 85 with the plurality of bolts 88.

As illustrated in FIG. 7, the positions of the buckets 84 approximately match the side surface section 82 of the front body section 11 in the radial direction while the buckets 84 are disposed in the storage position P2. That is, the buckets 84 are contained on the radial inward side of the side surface section 82 in the storage position P2.

In this way, the buckets 84 move from the excavating position P1 to the storage position P2 whereby the outer diameter of the front body section 11 can be reduced.

(Peripheral Plates 27)

Figure 8A:
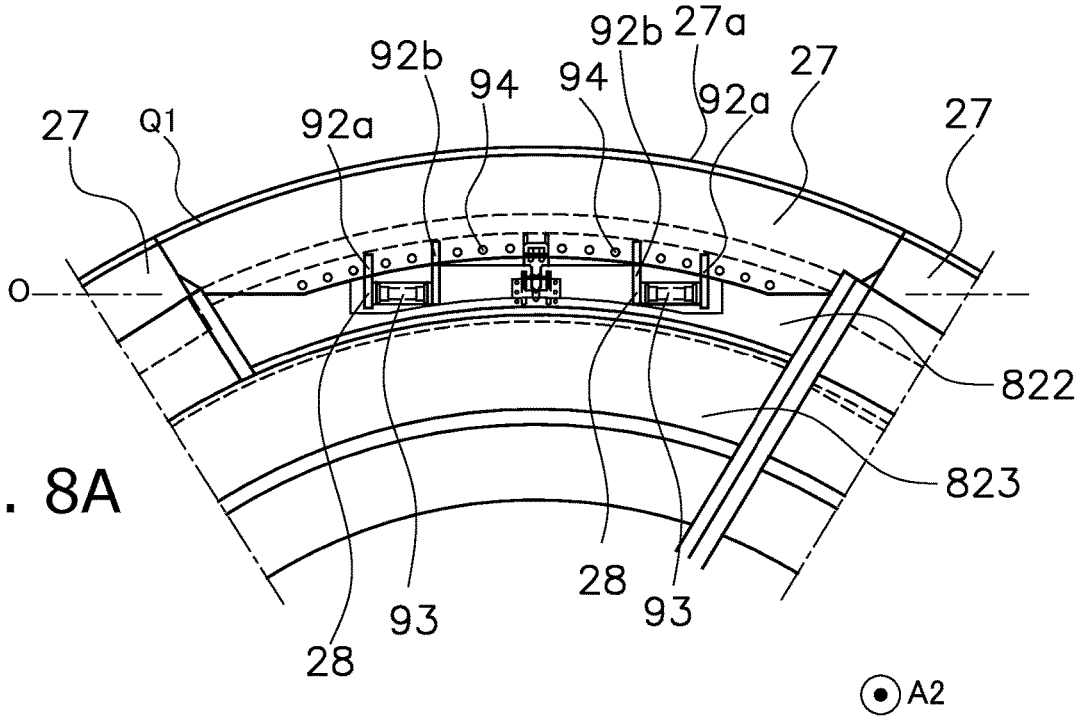
FIG. 8A is a back view of a state in which a peripheral plate in FIG. 1A is disposed in the excavating position as seen from the rear.
Figure 9A:
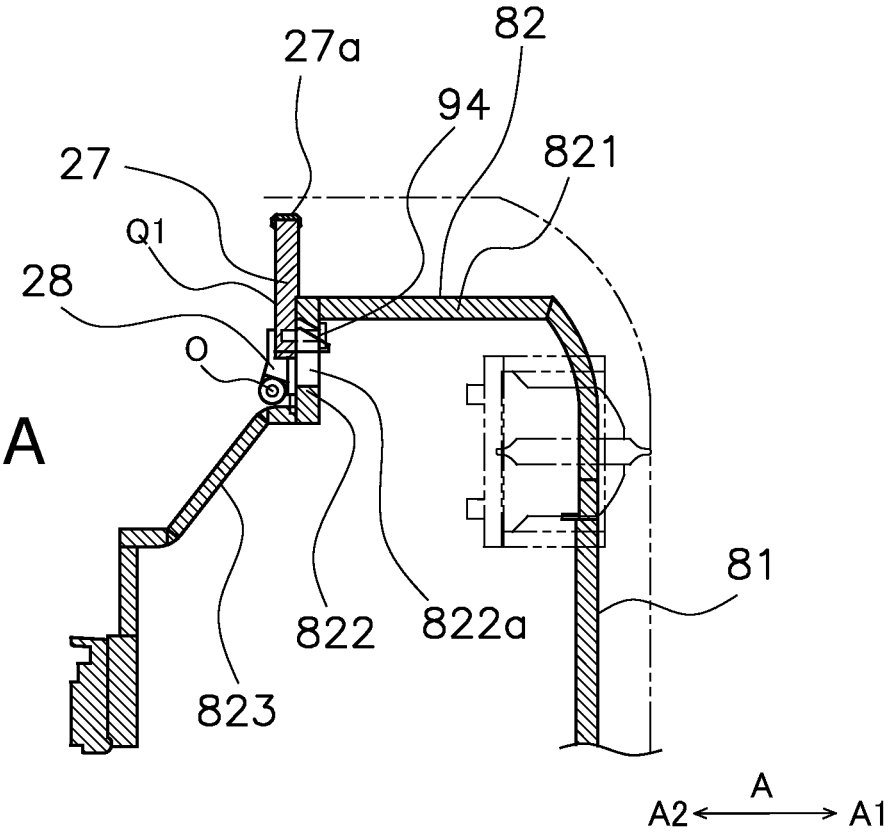
FIG. 9A is a side cross-sectional view of a state in which the peripheral plate in FIG. 1A is disposed in the excavating position.

FIG. 8A is a back view of the peripheral plates 27 as seen from the rear. FIG. 9A is a side cross-sectional view of the peripheral plates 27.

Each of the plurality of peripheral plates 27 (example of a collapsing section, example of a circumferential edge plate) are disposed so as to be able to collapse with respect to the side surface section 82. The plurality of peripheral plates 27 are disposed so as to protrude toward the outside from the side surface section 82.

The plurality of peripheral plates 27 are disposed in a line in the circumferential direction and straddle the entire circumference of the side surface section 82.

The peripheral plates 27 are fan-shaped as seen from the front. In the present embodiment, for example, six peripheral plates 27 are disposed in the circumferential direction and each of the peripheral plates 27 have a fan shape the central angle of which is approximately 60 degrees.

The peripheral plates 27 are each attached with a plurality of fixing bolts 94 to the outside of the rear surface 822 of the side surface section 82 as illustrated in FIG. 9A.

When traveling in reverse, the peripheral plates 27 are configured to be able to collapse so that the diameter of the front body section 11 can be reduced.

The peripheral plates 27 are rotatably attached to the rear side of the rear surface 822 with hinge sections 28. Two hinge sections 28 are provided and are disposed side by side on the same axis. Each of the hinge sections 28 have supporting members 92*a* and 92*b* and a turning shaft section 93. The supporting members 92*a* and 92*b* are fixed to the peripheral plates 27 and extend from the peripheral plates 27 toward the rear surface 822. The turning shaft section 93 has a through-hole on the inside. A shaft member that is linked to the end of the supporting member 92*a* and the end of the supporting member 92*b* is inserted into the through-hole. With this configuration, the outer circumferential ends 72*a* of the peripheral plates 27 turn toward the rear about the turning shaft sections 93. The turning shaft is depicted in FIG. 8A as O.

Figure 8B:
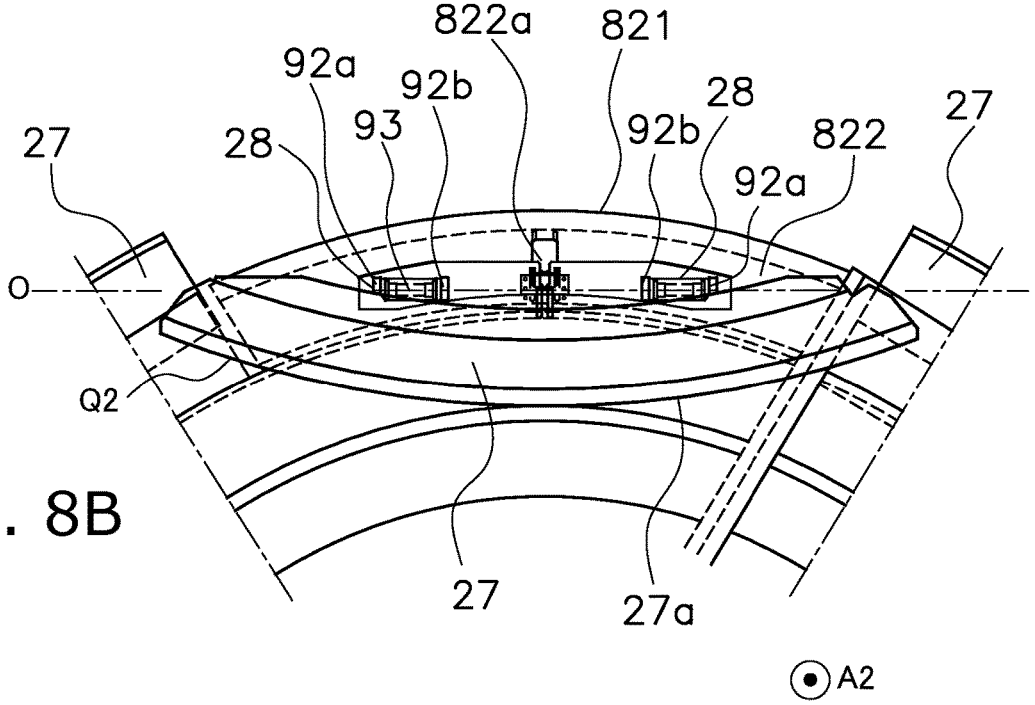
FIG. 8B is a back view of a state in which a peripheral plate in FIG. 1A is disposed in the storage position as seen from the rear.
Figure 9B:
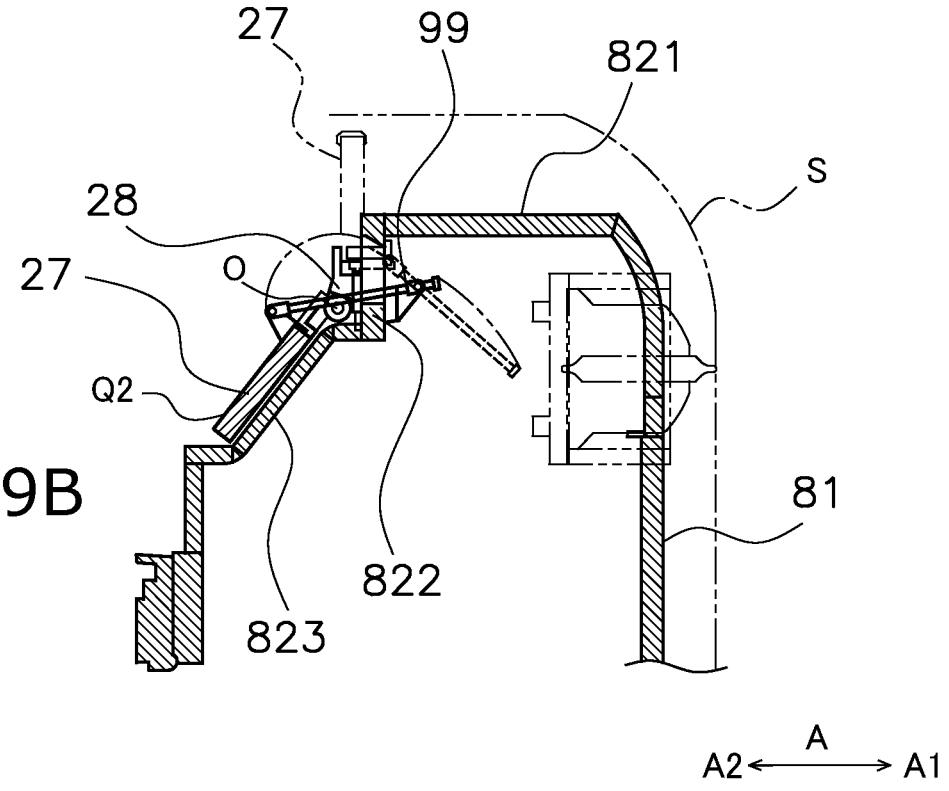
FIG. 9B is a back view of a state in which the peripheral plate in FIG. 1A is disposed in the excavating position as seen from the rear.

FIG. 8B is a diagram illustrating a state in which the peripheral plates 27 in the back view of FIG. 8A are turned toward the rear. FIG. 9B is a diagram illustrating a state in which the peripheral plates 27 in the side view of FIG. 9A are turned toward the rear.

As illustrated in FIG. 9B, the peripheral plates 27 are collapsed toward the rear along the connection surface 823. As a result, the outer surface 821 becomes the component positioned the furthest to the outside of the front body section 11. While the peripheral plates 27 on either side are not collapsed in FIG. 8B, the diameter of the front body section 11 is reduced due to all of the peripheral plates 27 being collapsed.

In FIG. 9B, a peripheral plate 27 before collapsing is depicted with the chain double-dashed line. The state in which the peripheral plates 27 protrude to the outside of the outer surface 821 is illustrated as an excavating position Q1, and the state in which the peripheral plates 27 are collapsed to the rear is illustrated as a storage position Q2. In FIG. 9B and FIG. 6, the outer diameter of the front body section 11 when the peripheral plates 27 are disposed in the excavating position Q1 and the buckets 84 are disposed in the excavating position P1 is depicted with the chain double-dashed line S.

A method for collapsing the peripheral plates 27 is explained below. FIGS. 10A to 10D are diagrams for explaining the method for collapsing the peripheral plates 27.

A collapsing jig 99 is used when collapsing the peripheral plates 27 from the excavating position Q1 to the storage position Q2.

Figure 10A:
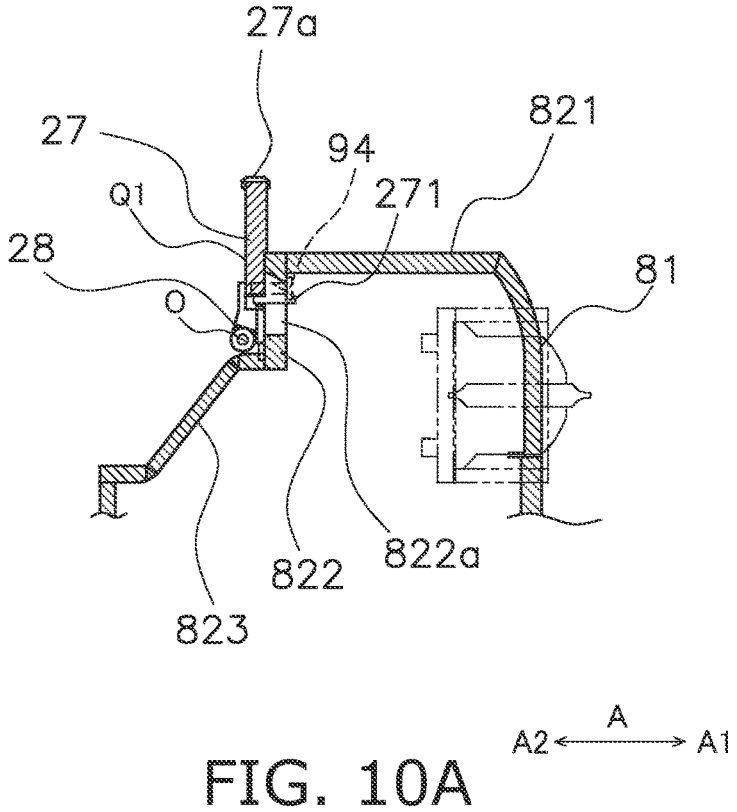
FIG. 10A is a side cross-sectional view for explaining the movement of the peripheral plate from the excavating position to the storage position.
Figure 10B:
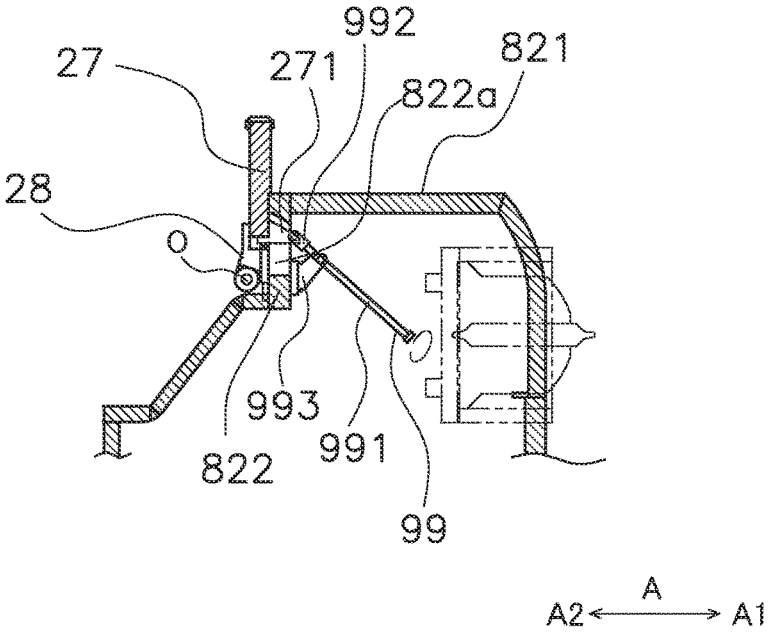
FIG. 10B is a side cross-sectional view for explaining the movement of the peripheral plate from the excavating position to the storage position.

As illustrated in FIG. 10B, the collapsing jig 99 has a rod-like screw section 991, a tip end section 992 at the tip end of the screw section 991 that can rotate with respect to the screw section 991, and a support section 993 that is screwed to the screw section 991 and supports the collapsing jig 99 on the rear surface 822. A penetrating threaded hole is formed in the support section 993 and the screw section 991 is inserted into the threaded hole.

As illustrated in FIG. 10A, a through-hole 822*a* is formed in the rear surface 822. An attachment member 271 that penetrates the through-hole 822*a* so that the tip end of the collapsing jig 99 can be rotatably attached, is formed on the front surface of each peripheral plate 27.

As illustrated in FIG. 10A, a plurality of fixing bolts 94 for fixing the peripheral plates 27 to the rear surface 822 are removed.

Next, as illustrated in FIG. 10B, the collapsing jig 99 is attached and the support section 993 of the collapsing jig 99 is attached to the lower side of the through-hole 822*a* of the rear surface 822 and the tip end section 992 is attached to the attachment member 271 provided to each peripheral plate 27.

Figure 10C:
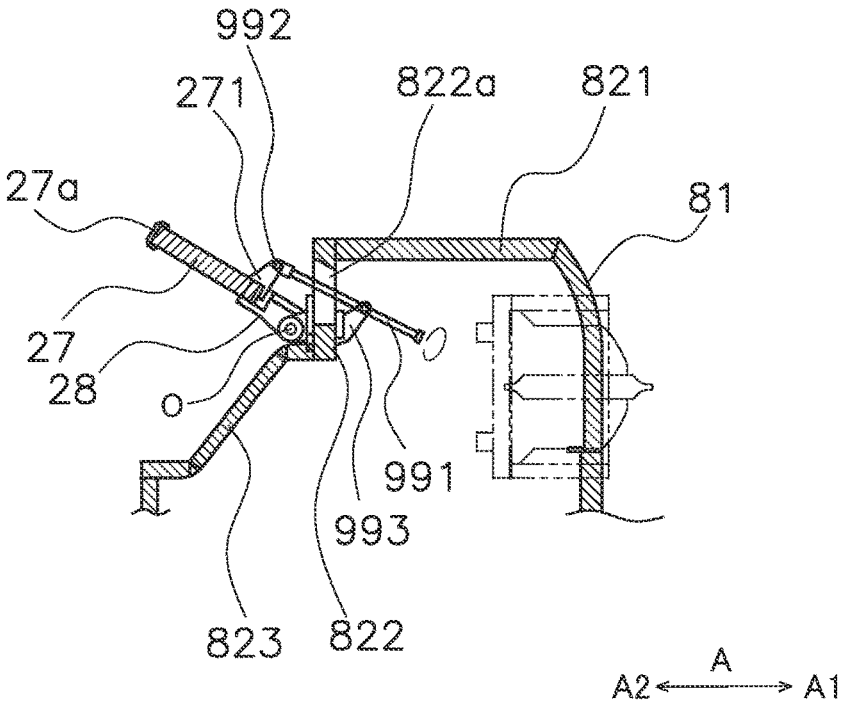
FIG. 10C is a side cross-sectional view for explaining the movement of the peripheral plate from the excavating position to the storage position.

Next, as illustrated in FIG. 10C, when the screw section 991 of the collapsing jig 99 is rotated, the screw section 991 and the tip end section 992 supported by the support section 993 move toward the rear while being turned. The tip end section 992 and the screw section 991 are inserted into the through-hole 822*a* of the rear surface 822 and the attachment member 271 and the peripheral plate 27 turn toward the rear about the turning shaft O of the hinge sections 28 while being pushed by the tip end section 992.

Figure 10D:
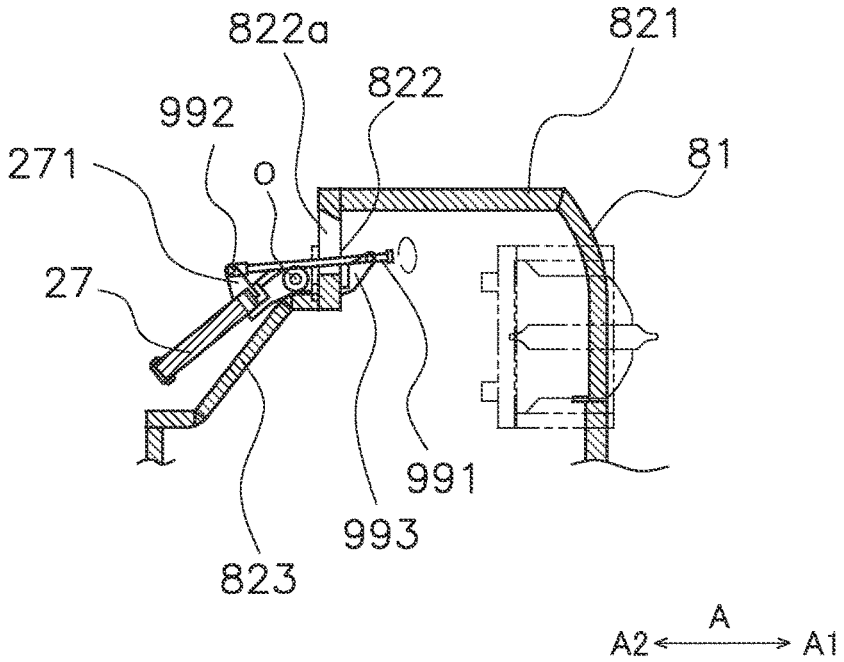
FIG. 10D is a side cross-sectional view for explaining the movement of the peripheral plate from the excavating position to the storage position.

When the screw section 991 is further rotated after the state of FIG. 10C, the peripheral plate 27 moves through the state depicted in FIG. 10D and moves to the storage position Q2 along the connection surface 823 as illustrated in FIG. 9B.

In this way, all of the peripheral plates 27 are moved from the excavating position Q1 to the storage position Q2 whereby the outer diameter of the front body section 11 can be reduced.

When the buckets 84 are moved to the storage position P2 and the peripheral plates 27 are moved to the storage position Q2, the roller cutters 83 provided to the side surface section 82 are drawn inward and fixed. The roller cutters 83 provided to the side surface section 82 are illustrated as roller cutters 83' in FIG. 3A and FIG. 3B.

(Vertical Support 23)

Figure 11:
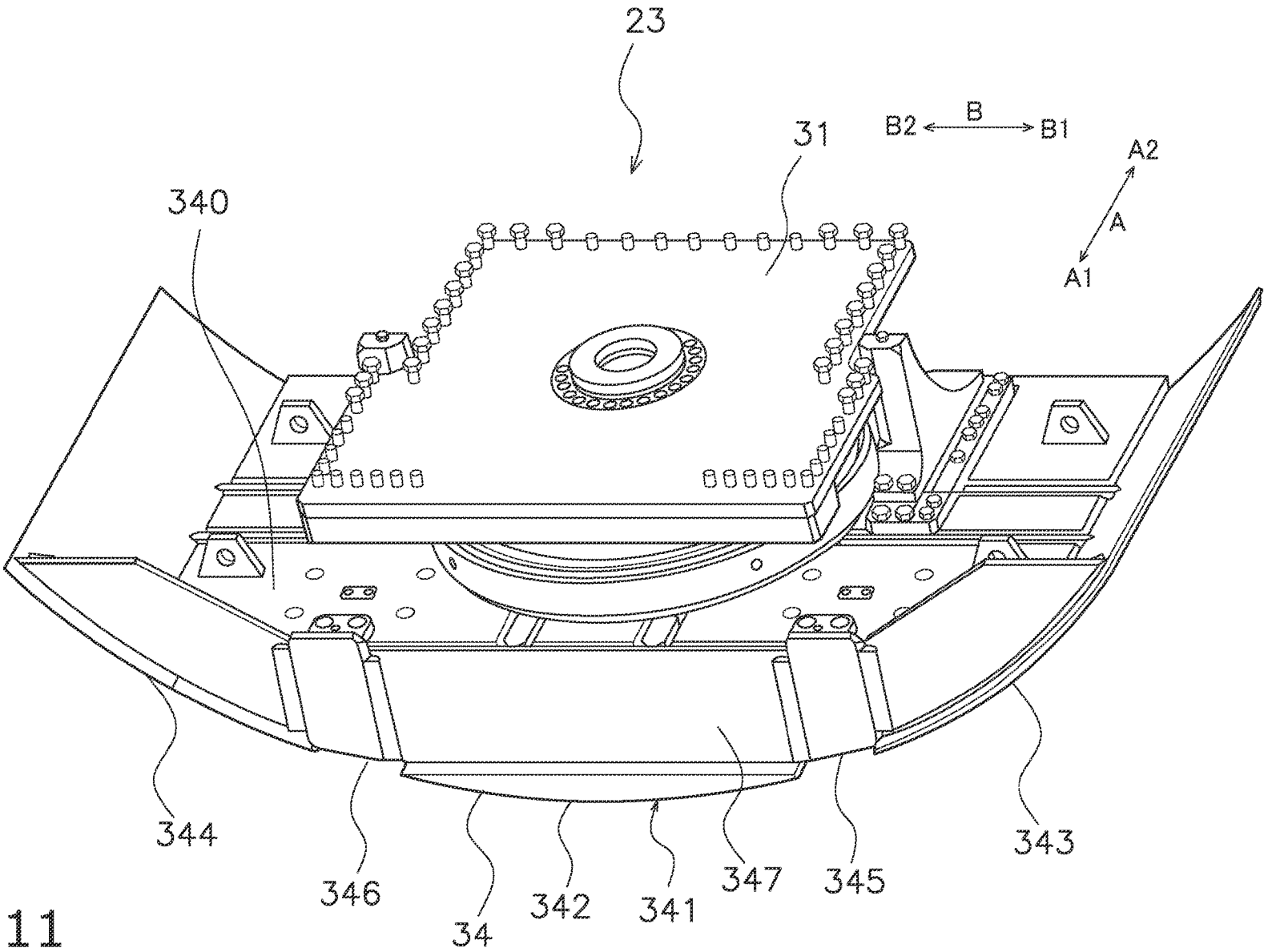
FIG. 11 is a perspective view illustrating a vertical support of the tunnel excavation device in FIG. 1A.
Figure 12:
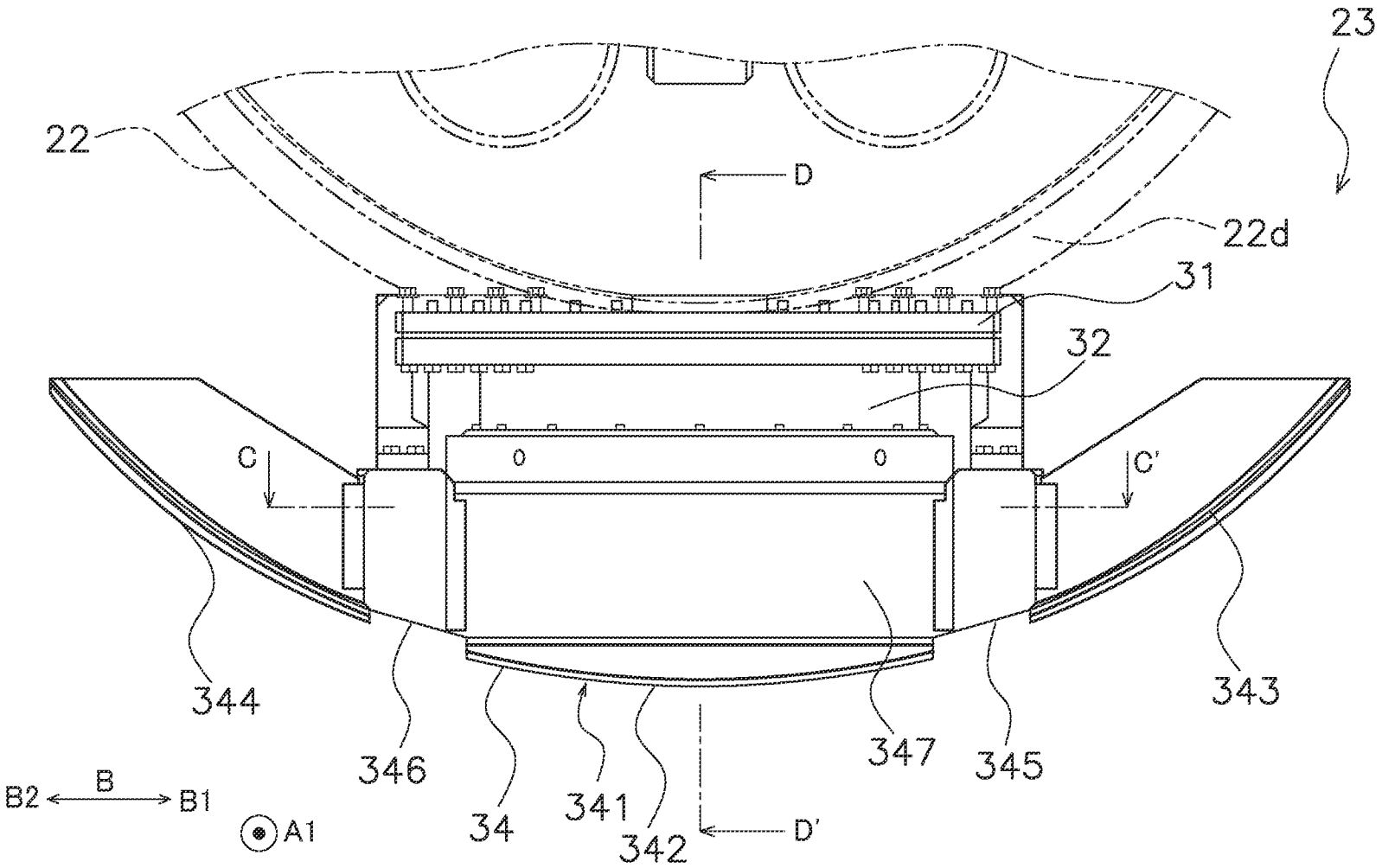
FIG. 12 is a front view of the vertical support in FIG. 11.
Figure 13:
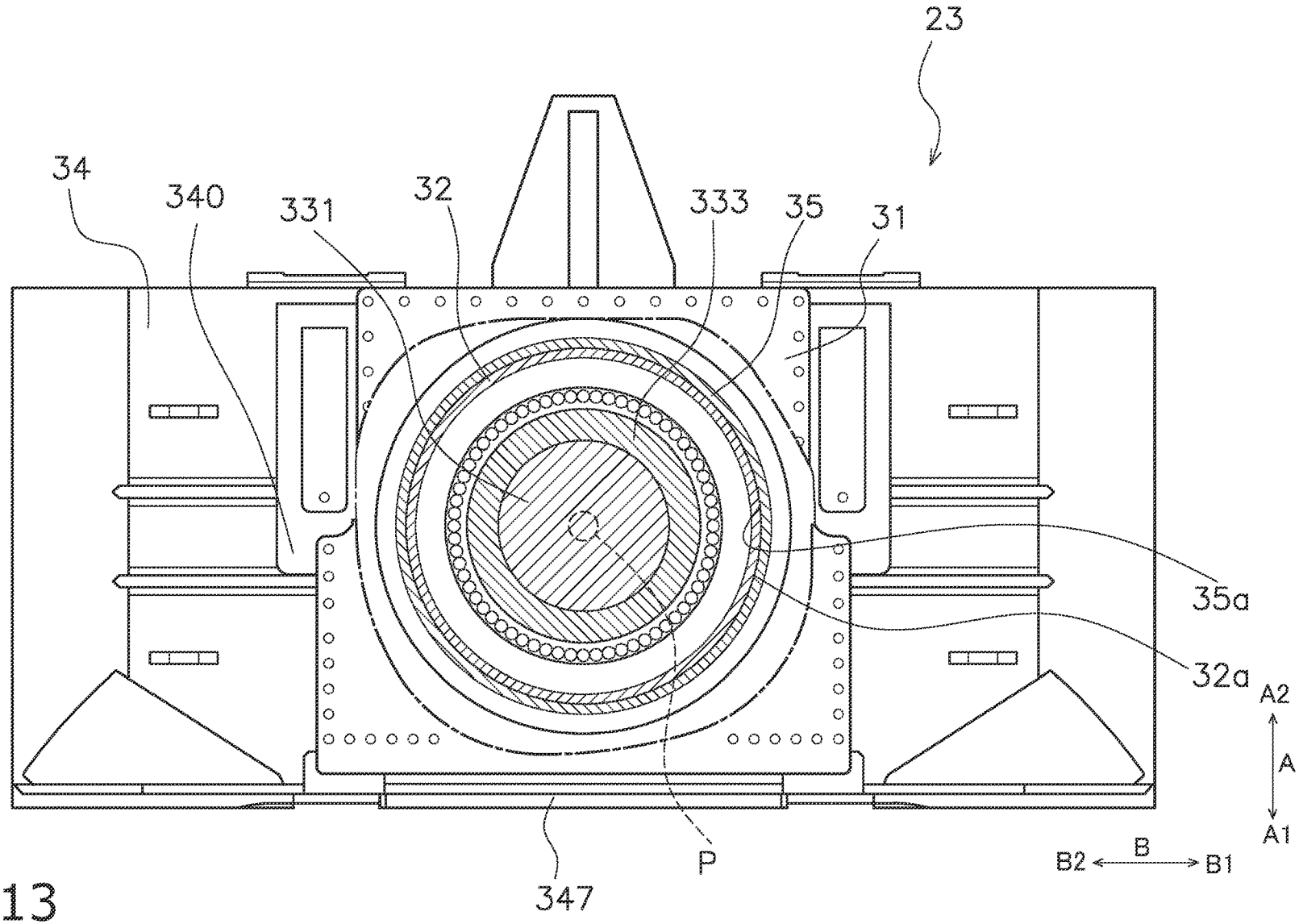
FIG. 13 is a partial cross-sectional plan view of the vertical support in FIG. 11.
Figure 14:
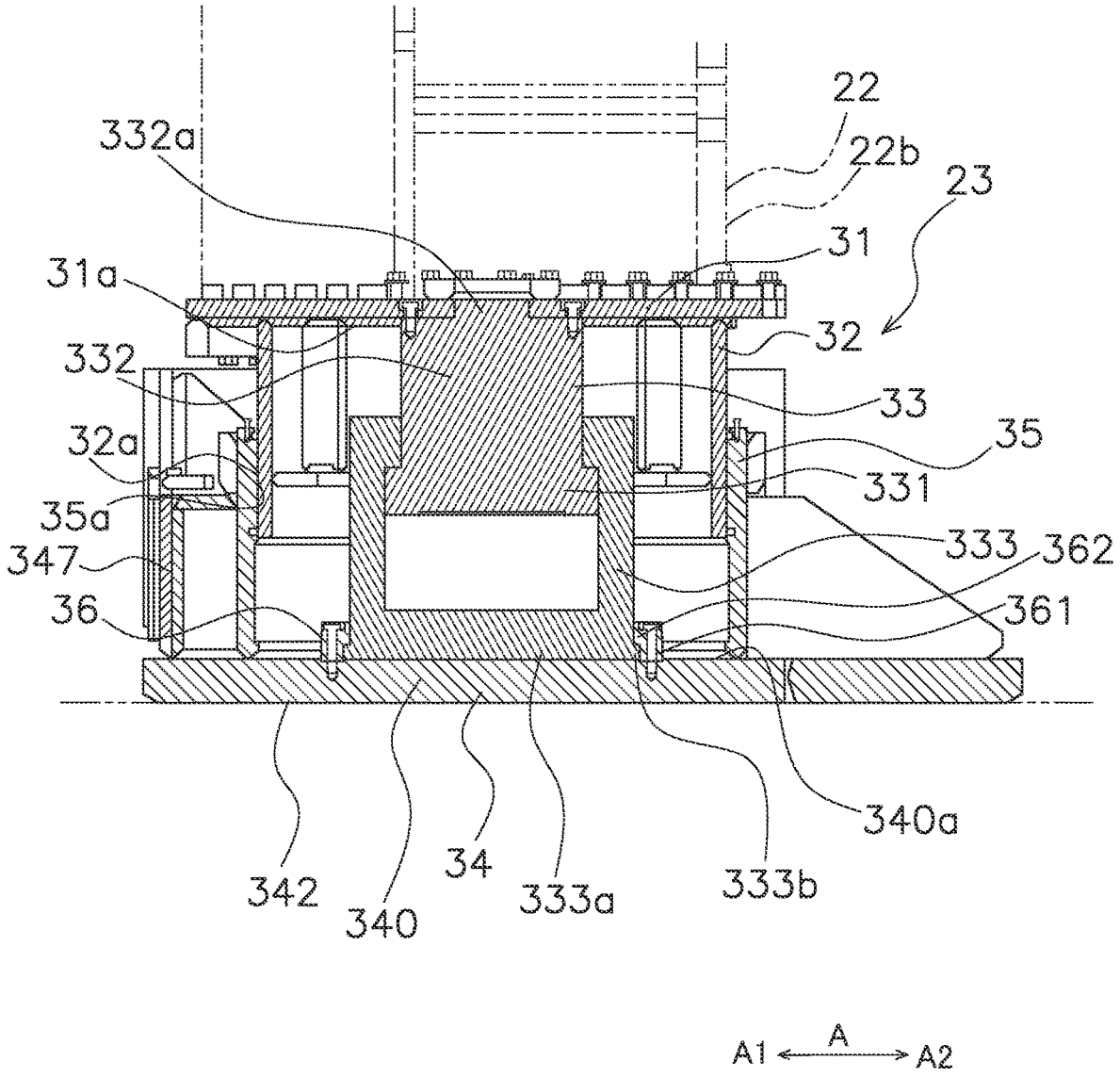
FIG. 14 is a cross-sectional view between arrows D and D' in FIG. 12.

FIG. 11 is a perspective view illustrating the vertical support 23. FIG. 12 is a front view illustrating the vertical support 23 as seen from the front. FIG. 13 is a plan view of the vertical support 23 and the portion enclosed in the chain line is a cross-sectional view between arrows C and C' in FIG. 12. FIG. 14 is a cross-sectional view between arrows D and D' in FIG. 12.

As illustrated in FIG. 14, the vertical support 23 has an attachment member 31, a guide 32, a hydraulic cylinder 33, a vertical shoe 34, and an outer circumferential section 35.

The attachment member 31 has a plate shape and is fixed to a lower section 22*d* of the cutter head support 22 with bolts as illustrated in FIG. 12.

The guide 32 has a cylindrical shape and is disposed on a lower surface 31*a* of the attachment member 31 as illustrated in FIG. 14. The guide 32 is fixed to the attachment member 31. The guide 32 is disposed so that the center axis thereof is perpendicular to the attachment member 31. The attachment member 31 and the guide 32 are fixed to the cutter head support 22.

The hydraulic cylinder 33 is disposed on the lower side of the attachment member 31 and is fixed to the attachment member 31 as illustrated in FIG. 14. The hydraulic cylinder 33 is able to expand and contract in the up-down direction. The hydraulic cylinder 33 has a piston 331, a rod 332, and a cylinder 333. The piston 331 is disposed inside the cylinder 333 so as to be able to move in the up-down direction. The rod 332 extends upward from the piston 331. A tip end 332*a* of the rod 332 is fixed to the attachment member 31. A lower end 333*a* of the cylinder 333 is rotatably engaged with the vertical shoe 34. The hydraulic cylinder 33 is provided in the center of the cylindrical guide 32. That is, the hydraulic cylinder 33 is disposed so that the center axis of the guide 32 matches the center axis of the rod 332 of the hydraulic cylinder 33.

The vertical shoe 34 is able to slide on the ground surface of the tunnel. The vertical shoe 34 has a frame section 340, a sliding surface 341, and a cover 347 as illustrated in FIG. 11.

The lower end 333*a* of the cylinder 333 of the hydraulic cylinder 33 is rotatably engaged with the frame section 340 as illustrated in FIG. 14. The cylinder 333 has an edge section 333*b* that protrudes to the outside at the lower end 333*a*. The edge section 333*b* is formed along the entire circumference of the cylinder 333.

An annular engagement member 36 for rotatably engaging with the edge section 333*b* is fixed with bolts, etc., to an upper surface 340*a* of the frame section 340. The engagement member 36 has an outer edge section 361 positioned outside of the edge section 333*b*, and an eave section 362 that covers the upper part of the edge section 333*b*. Consequently, the frame section 340 can turn with respect to the cylinder 333.

The sliding surface 341 is provided so as to surround the outside of the frame section 340 as illustrated in FIG. 11. The sliding surface 341 is formed in an arc shape that protrudes downward as seen in the front view in FIG. 12. The sliding surface 341 is formed horizontally in a side surface cross-section.

The sliding surface 341 is divided into three sections in the width direction and has a center surface 342, a left side surface 343, and a right side surface 344. The center surface 342 is positioned in the center in the width direction of the sliding surface 341. The left side surface 343 is disposed on the left side of the center surface 342 facing the forward direction A1. The right side surface 344 is disposed on the right side of the center surface 342 facing the forward direction A1. A recessed section 345 is formed along the front-back direction A between the center surface 342 and the left side surface 343. Additionally, a recessed section 346 is formed along the front-back direction A between the center surface 342 and the right side surface 344.

A cover 347 blocks rocks and the like from hitting the guide 32 from the front. The cover 347 is provided on the front side of the outer circumferential section 35 and the guide 32, etc. The cover 347 is fixed to the frame section 340 and is provided on the upper side of the sliding surface 341 along the front end of the sliding surface 341.

The outer circumferential section 35 is disposed outside of the guide 32. The outer circumferential section 35 has a cylindrical portion and the cylindrical portion is disposed outside of the guide 32 as illustrated in FIG. 13. An outer circumferential surface 32*a* of the guide 32 is able to slide with an inner circumferential surface 35*a* of the cylindrical portion of the outer circumferential section 35. The outer circumferential section 35 is fixed to the upper surface 340*a* of the frame section 340.

Figure 15:
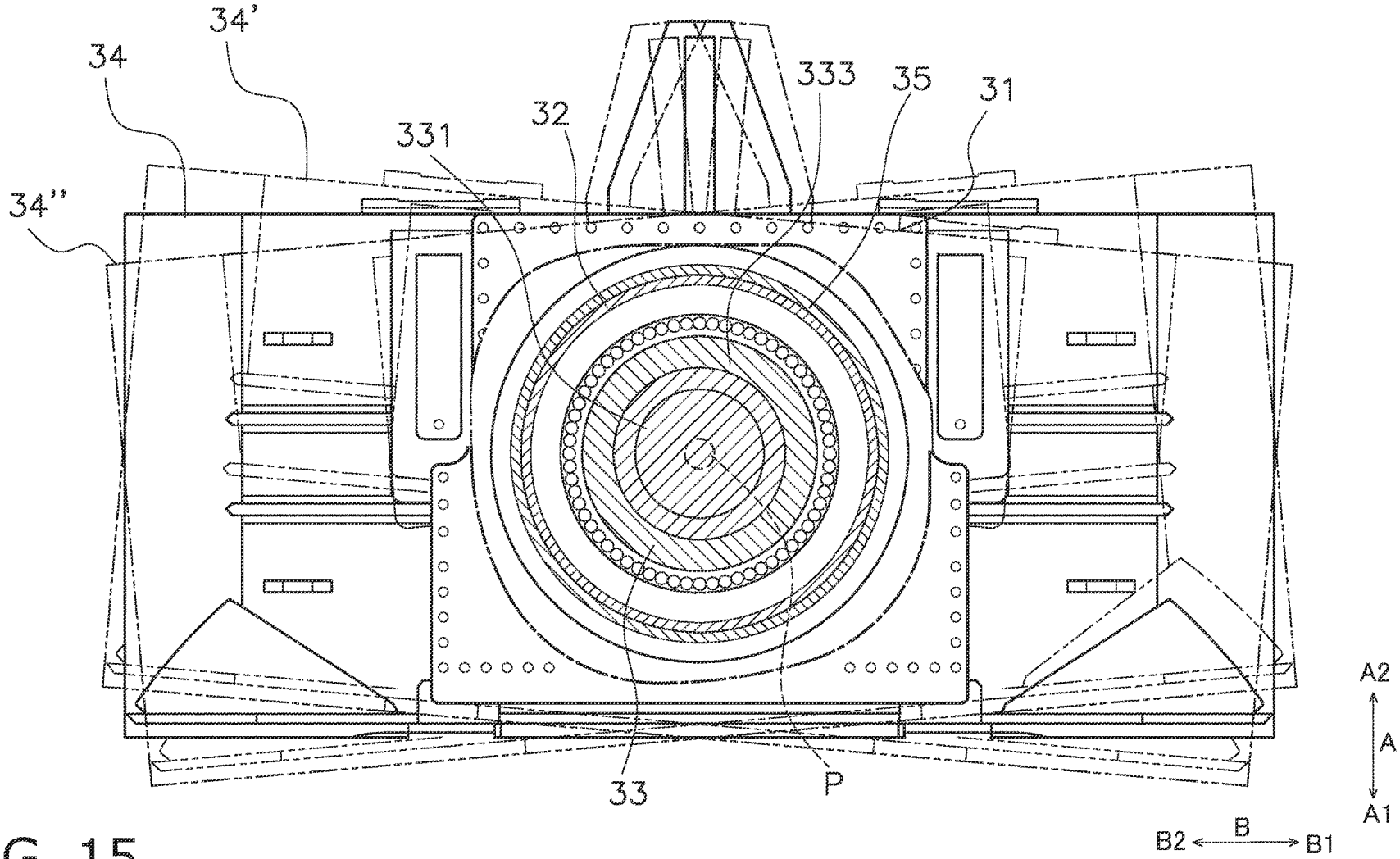
FIG. 15 is a plan view illustrating turning of the vertical shoe of the vertical support in FIG. 11.

The vertical shoe 34 is engaged with the hydraulic cylinder 33 in a turnable manner and the hydraulic cylinder 33 is fixed to the attachment member 31 to the cutter head support 22 whereby the vertical shoe 34 is able to turn around the center axis P of the hydraulic cylinder 33 as illustrated in FIG. 15. In FIG. 15, the state of the vertical shoe 34 turned clockwise in a plan view is depicted with 34', and the state of the vertical shoe 34 turned anticlockwise in a plan view is depicted with 34". Consequently, the vertical shoe 34 is able to turn and follow a curved line when the tunnel excavation device 1 travels in reverse along the curved line.

Figure 16:
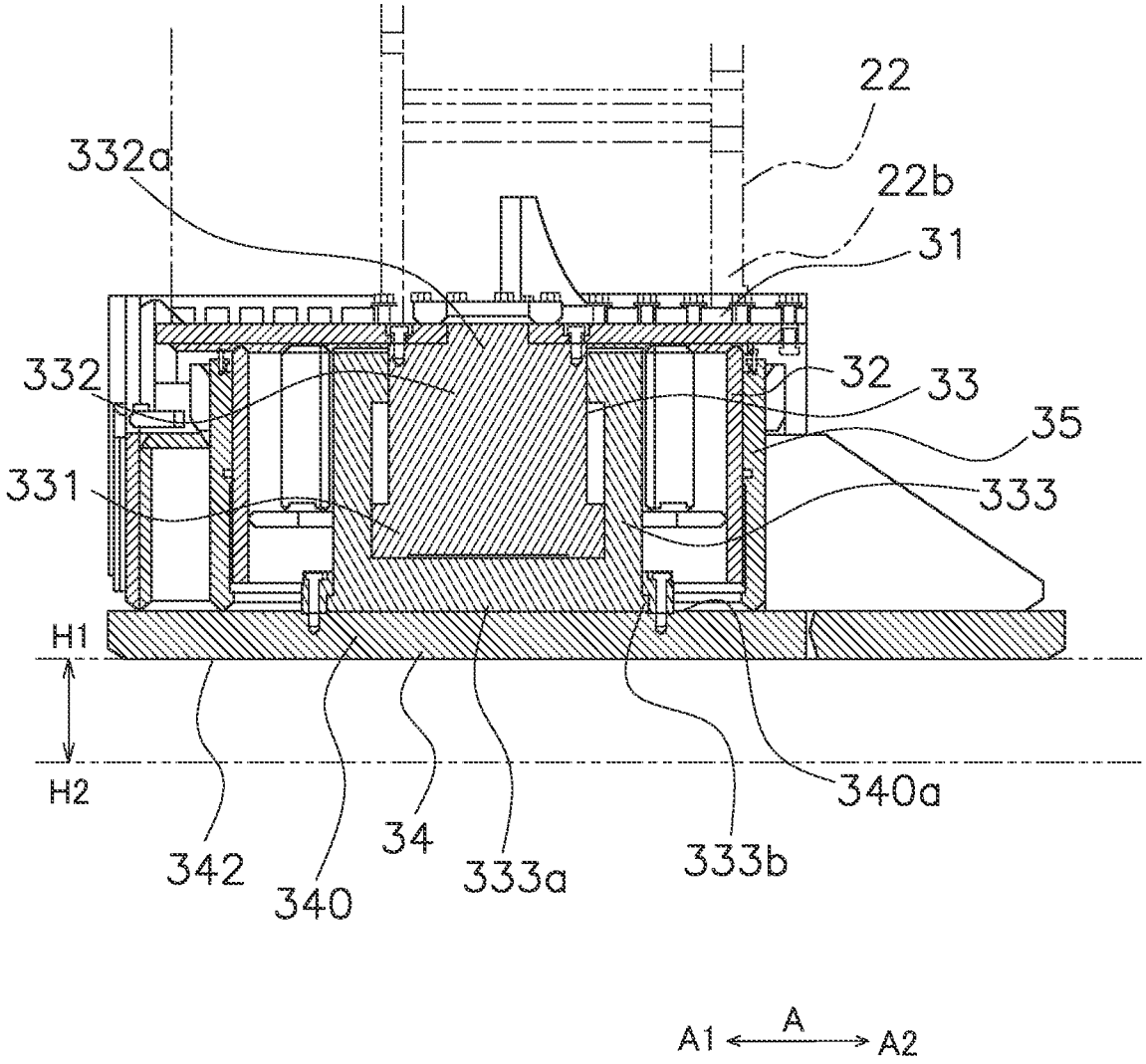
FIG. 16 is a diagram illustrating a state in which the vertical shoe in FIG. 14 approaches the cutter head support.

In addition, because the vertical shoe 34 is attached to the cutter head support 22 via the hydraulic cylinder 33, the vertical shoe 34 is able to move closer (move upward) to the cutter head support 22 due to the contraction of the hydraulic cylinder 33 as illustrated in FIG. 16 (see H1 in FIG. 16). In addition, the vertical shoe 34 is able to move away from (move downward) the cutter head support 22 due to the extension of the hydraulic cylinder 33 (see H2 in FIG. 16).

(Side Supports 24, 25)

The side supports 24 and 25 are disposed on either side in the width direction of the cutter head support 22 as illustrated in FIG. 2. The side support 24 is disposed on the B1 direction side of the cutter head support 22 and the side support 25 is disposed on the B2 direction side of the cutter head support 22.

Each of the side supports 24 and 25 have a side shoe 41, a side shoe coupling section 42, a parallel link 43 (example of a first link section), and hydraulic cylinders 44.

Figure 17A:
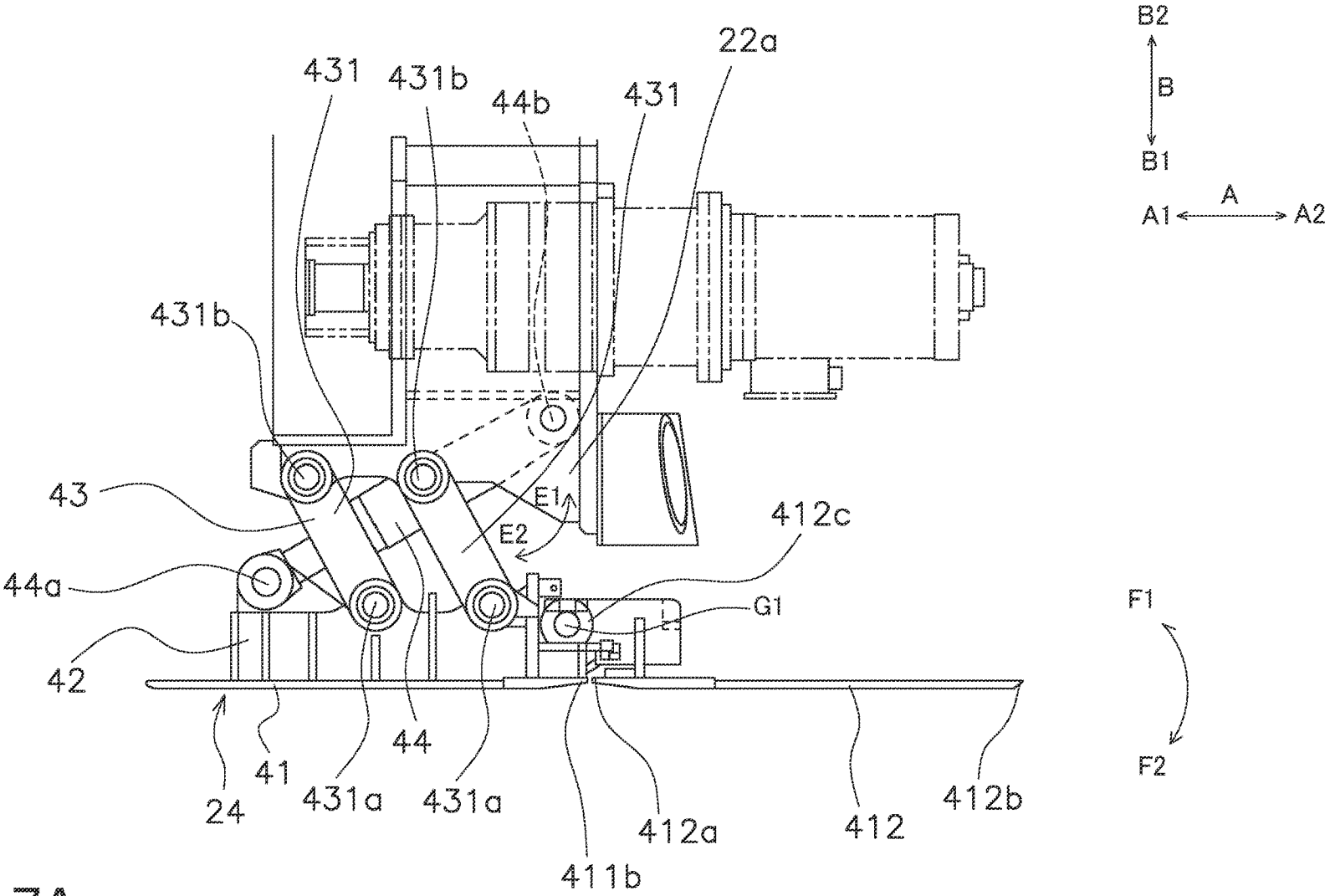
FIG. 17A is an enlargement of a side support in FIG. 2.
Figure 17B:
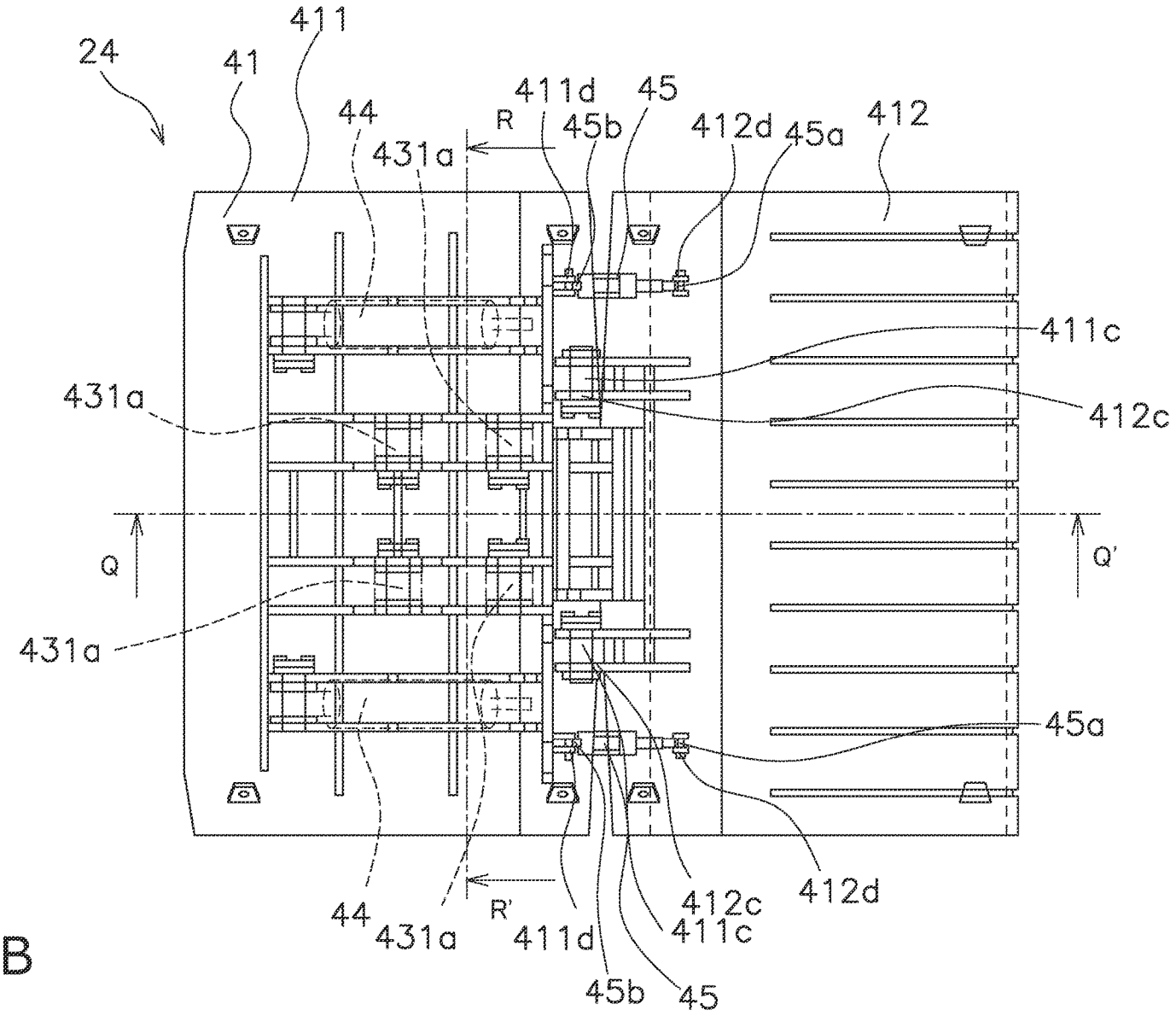
FIG. 17B is a rear view of the side support in FIG. 2.
Figure 17C:
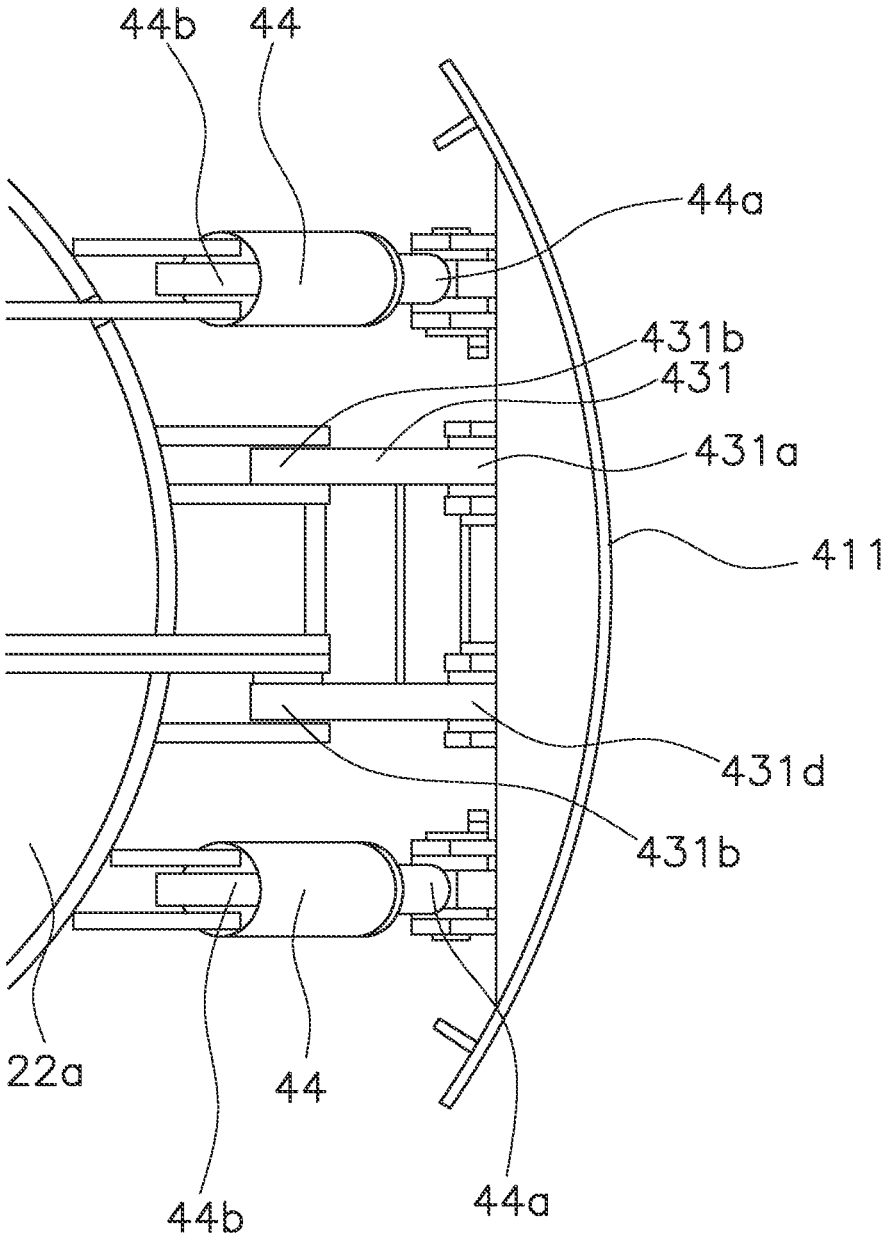
FIG. 17C is a cross-sectional view between arrows Q and Q' in FIG. 17B.

The side support 24 and the side support 25 are disposed symmetrically while sandwiching the cutter head support 22 and have the same configurations and, therefore, the side support 24 will be used in the explanation. FIG. 17A is an enlargement in the vicinity of the side support 24 in FIG. 2. FIG. 17B is a rear view of the side support 24. FIG. 17A is a cross-sectional view between arrows Q and Q' in FIG. 17B. FIG. 17C is a cross-sectional view between arrows R and R' in FIG. 17B.

The side shoe 41 is disposed so as to cover the left side of the cutter head support 22 as illustrated in FIG. 1A and FIG. 2. The side shoe 41 is curved to protrude outward as seen along the front-back direction A.

The side shoe coupling section 42 is disposed on the cutter head support 22 side of the side shoe 41 as illustrated in FIG. 17A. The side shoe coupling section 42 is a portion for connecting with the cutter head support 22. A side section 22*a* of the cutter head support 22 is coupled to the side shoe coupling section 42 through the parallel link 43.

The parallel link 43 has two parallel coupling members 431. The two coupling members 431 are disposed side by side in the front-back direction A. The coupling members 431 are disposed parallel to each other. The coupling members 431 form an H-shape as seen in the front view as illustrated in FIG. 17C. A first end 431*a* of each coupling member 431 is rotatably attached to the side shoe coupling section 42 and a second end 431*b* of each coupling member 431 is rotatably attached to the side section 22*a*. The second end 431*b* of each of the coupling members 431 is disposed further toward the front than the first end 431*a*.

The hydraulic cylinders 44 are disposed substantially horizontally. In FIG. 17B, the outer diameter of the hydraulic cylinders 44 are illustrated with dashed lines. The hydraulic cylinders 44 are disposed on the upper side and lower side of the parallel link 43. The hydraulic cylinders 44 each have a cylinder and a rod that is connected to a piston disposed inside the cylinder. A first end 44*a* on the rod side is turnably attached to the side shoe coupling section 42. A second end 44*b* on the cylinder side is attached to the side section 22*a* in a turnable manner. The first end 44*a* is disposed further toward the front than the second end 44*b*. Rotating shafts of the first end 44*a* and the second end 44*b* of each hydraulic cylinder 44 are parallel to the vertical direction. In addition, the hydraulic cylinders 44 are disposed so as to intersect the parallel link 43 as seen in a plan view.

Figure 17D:
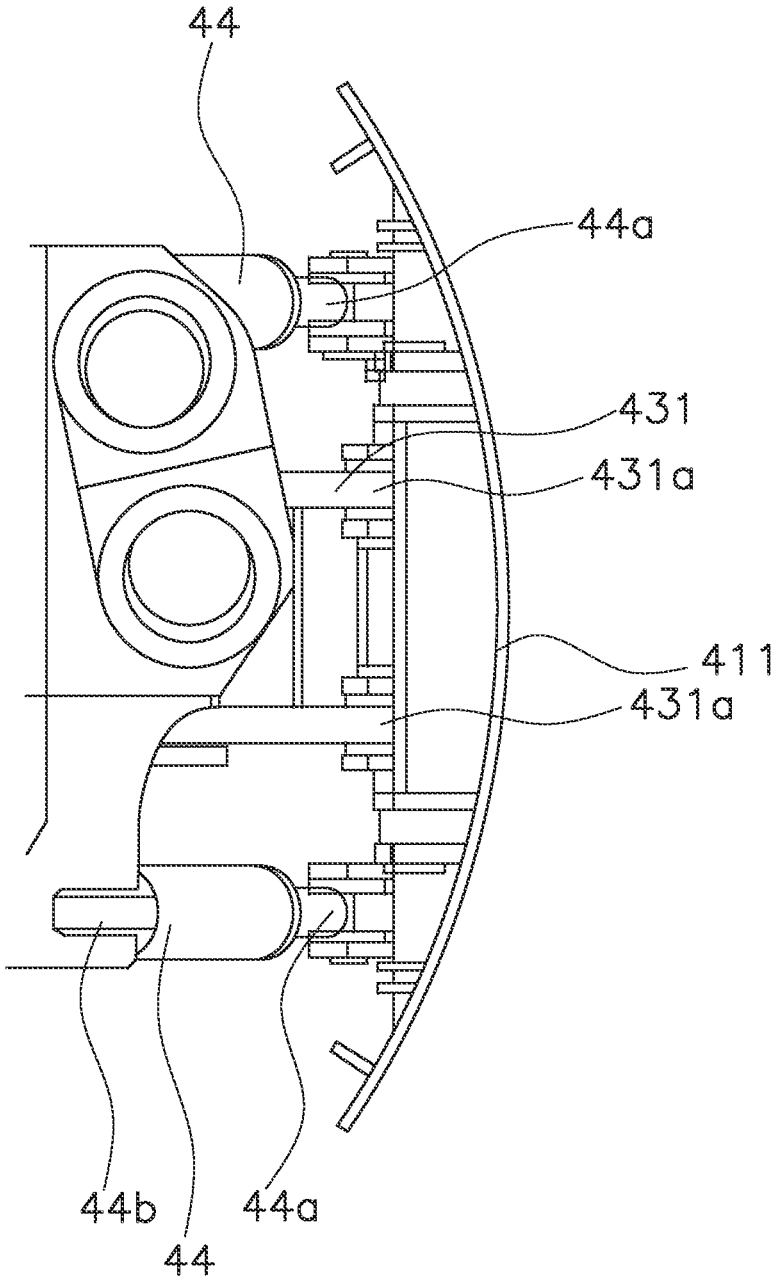
FIG. 17D is a cross-sectional view between arrows R and R' in FIG. 17B.

When the hydraulic cylinders 44 contract, the first ends 431*a* of the coupling members 431 of the parallel link 43 turn toward the side section 22*a* side about the second ends 431*b* (see arrow E1). Consequently, the side shoe 41 moves to the cutter head support 22 side and the diameter of the front body section 11 can be reduced as illustrated in FIG. 17D. FIG. 17D is a cross-sectional view between arrows R and R' in FIG. 17B.

Moreover, when the hydraulic cylinders 44 extend, the first ends 431*a* of the coupling members 431 of the parallel link 43 turn away from the side section 22*a* about the second ends 431*b* (see arrow E2). Consequently, the side shoe 41 moves away from the cutter head support 22 side and the diameter can be increased.

(Side Shoe 41)

The side shoe 41 (example of a collapsing section, example of a lateral shoe) has a side shoe front section 411 and a side shoe rear section 412 as illustrated in FIG. 17A and FIG. 17B. The side shoe coupling section 42 is provided to the side shoe front section 411. The side shoe rear section 412 is disposed to the rear of the side shoe front section 411. The side shoe rear section 412 is configured so that a rear end 412*b* is able to turn horizontally (see arrows F1 and F2) about coupling sections 412*c* coupled to a rear end 411*b* of the side shoe front section 411. In the present description, the horizontal direction, the up-down direction, the vertical direction, the front-back direction, the width direction, parallel, etc. are not strict meanings and may include tolerances and may be recognized as the socially-acceptable meanings.

A coupling section 411*c* is provided on the inside to the rear end 411*b* of the side shoe front section 411. Two coupling sections 411*c* are provided as illustrated in FIG. 17B and are disposed vertically. Two coupling sections 412*c* are provided on the inside to the front end 412*a* of the side shoe rear section 412, and each of the coupling sections 411*c* and the coupling sections 412*c* are formed with through-holes in the vertical direction and a shaft member is inserted into each of the through-holes. Consequently, the side shoe rear section 412 is able to turn with respect to the side shoe front section 411. In FIG. 17A, the coupling shaft in the up-down direction is depicted as G1. A plurality of notches are formed in the side shoe rear section 412 from the rear end 412*b* thereof in the forward direction A1 as illustrated in FIG. 1A.

Hydraulic cylinders 45 for turning the rear end 412*b* of the side shoe rear section 412 about the coupling shaft G1 are disposed extending from the side shoe front section 411 to the side shoe rear section 412. Two hydraulic cylinders 45 are disposed so as to sandwich the two coupling sections 411*c* and 412*c* from above and below as illustrated in FIG. 17B.

The hydraulic cylinders 45 are disposed substantially horizontally. The hydraulic cylinders 45 each have a cylinder and a rod that is connected to a piston disposed inside the cylinder. Coupling sections 412*d* are provided on the inside near the front end 412*a* of the side shoe rear section 412. A first end 45*a* on the rod side of each hydraulic cylinder 45 is rotatably attached to each coupling section 412*d*.

In addition, coupling sections 411*d* are provided on the inside near the rear end 411*b* of the side shoe front section 411. The coupling sections 411*d* are overlapped by the coupling sections 411*c* as seen in a plan view. A second end 45*b* on the cylinder side of each hydraulic cylinder 45 is rotatably attached to each coupling section 411*d*. Turning centers of the first end 45*a* and the second end 45*b* of each hydraulic cylinder 45 are approximately parallel to the vertical direction.

When the hydraulic cylinders 45 contract, the coupling sections 412*d* coupled to the first ends 45*a* turn toward the arrow F1 and therefore the rear end 412*b* of the side shoe rear section 412 turns in the direction of the arrow F1 about the coupling shaft G1. Consequently, the rear end 412*b* of the side shoe rear section 412 is able to move to the inside (in the direction approaching the cutter head support 22).

When the hydraulic cylinders 45 extend, the coupling sections 412*c* coupled to the first ends 45*a* turn toward the arrow F2 and therefore the rear end 412*b* of the side shoe rear section 412 turns in the direction of the arrow F2 about the coupling shaft G1. Consequently, the rear end 412*b* of the side shoe rear section 412 is able to move to the outside (in the direction away from the cutter head support 22).

(Roof Support 26)

The roof support 26 is disposed above the cutter head support 22.

Figure 18:
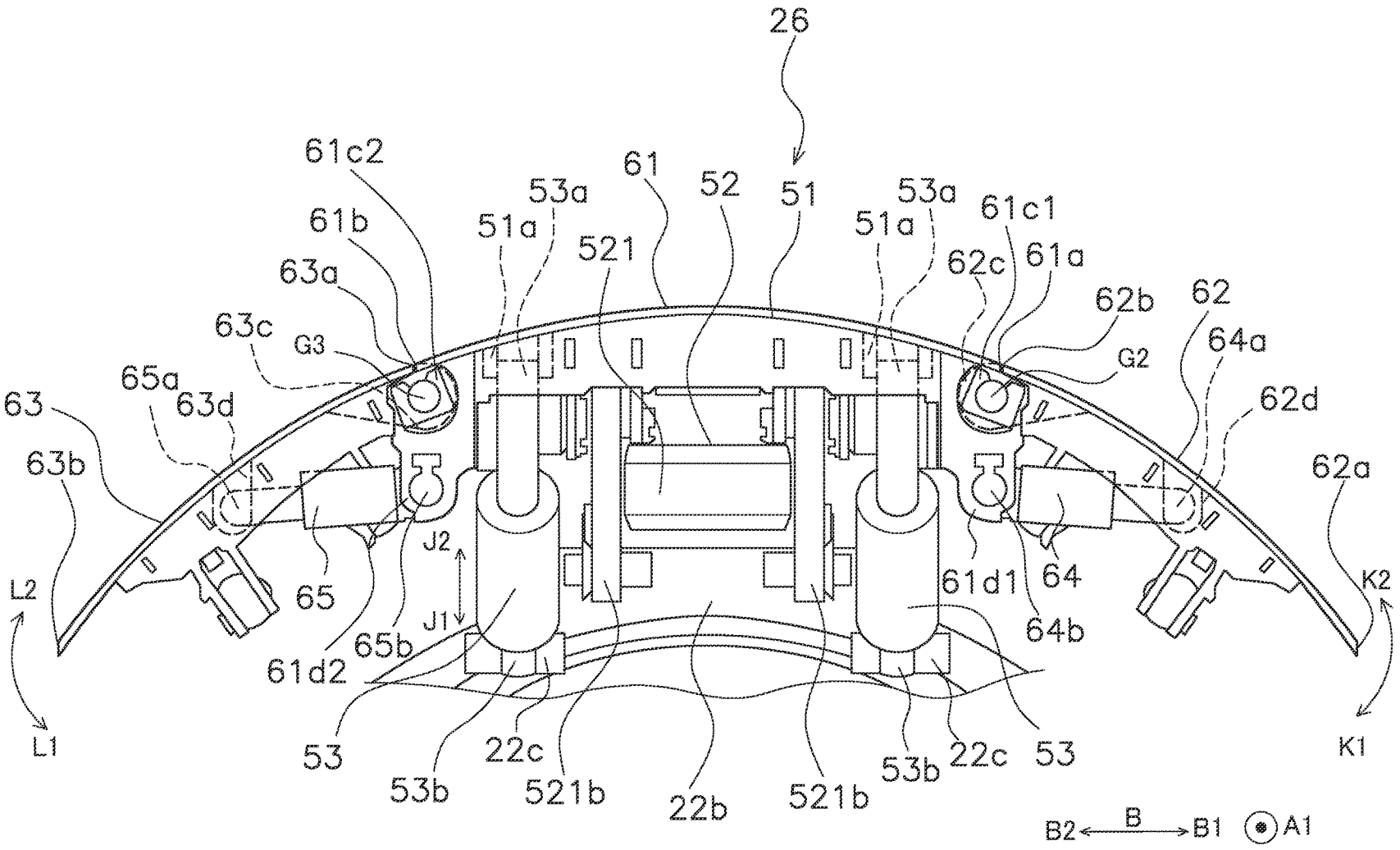
FIG. 18 is a front view of a roof support in FIG. 1A.
Figure 19A:
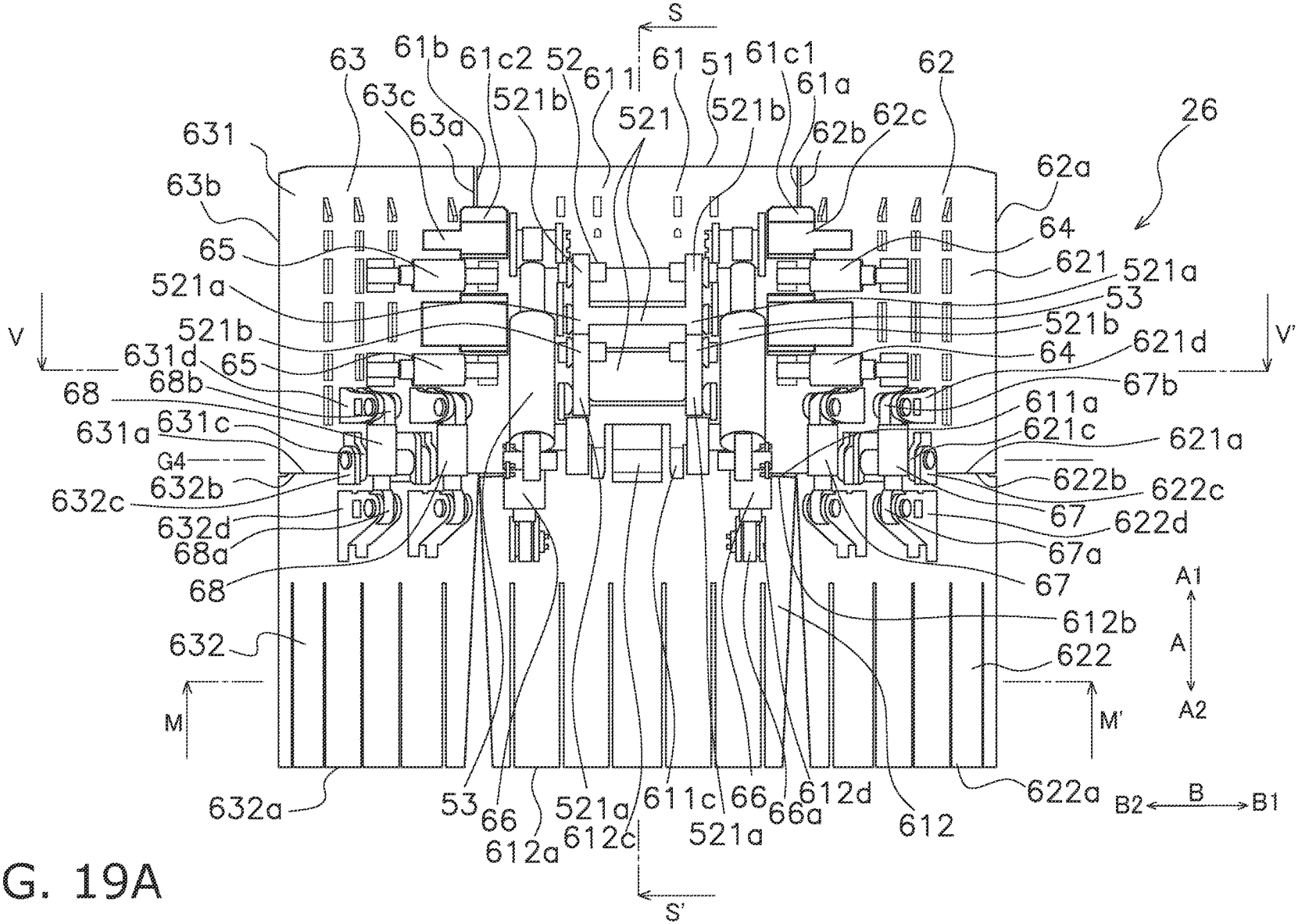
FIG. 19A is a bottom surface view of the roof support in FIG. 18.
Figure 19B:
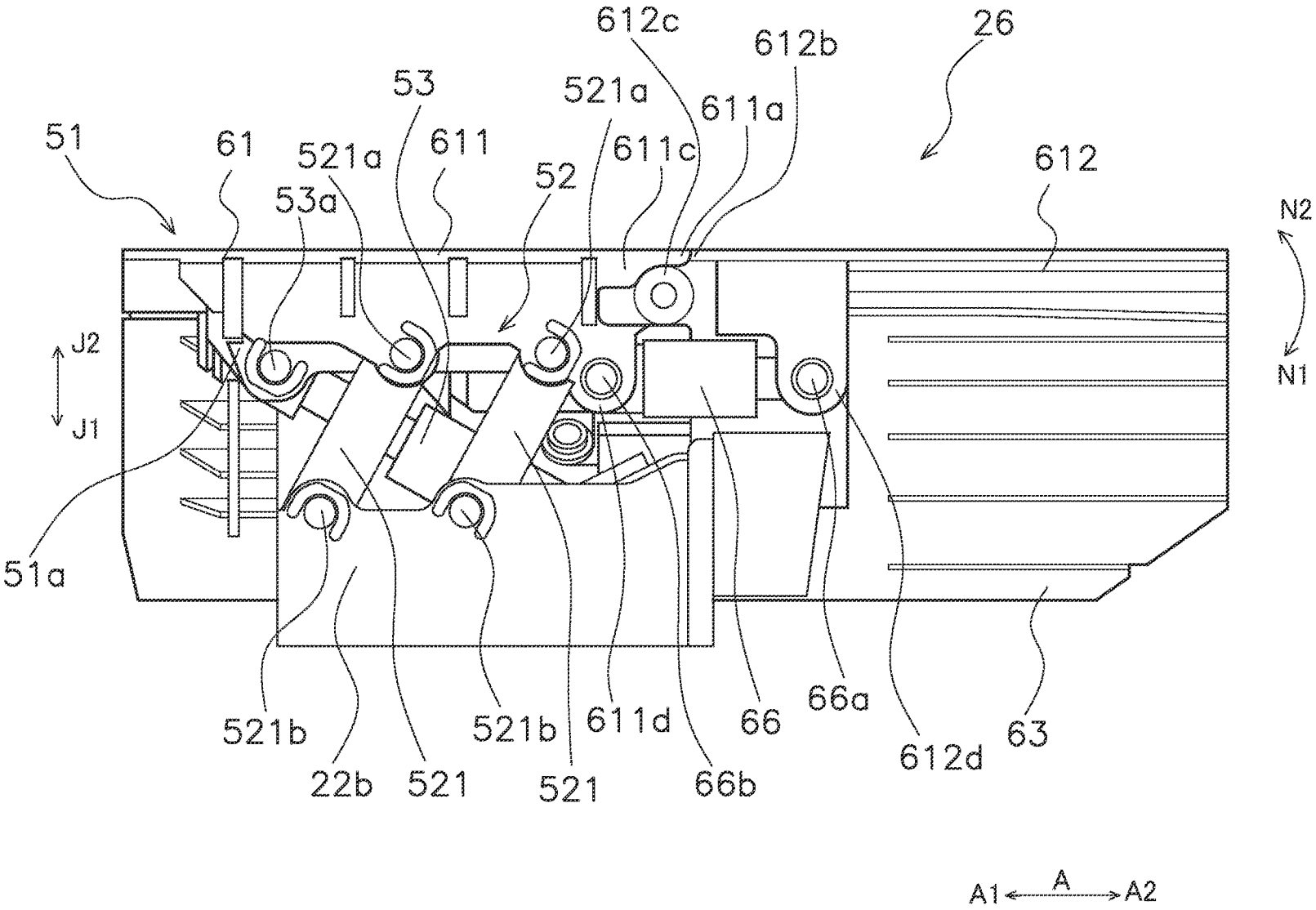
FIG. 19B is a cross-sectional view between arrows S and S' in FIG. 19A.
Figure 20:
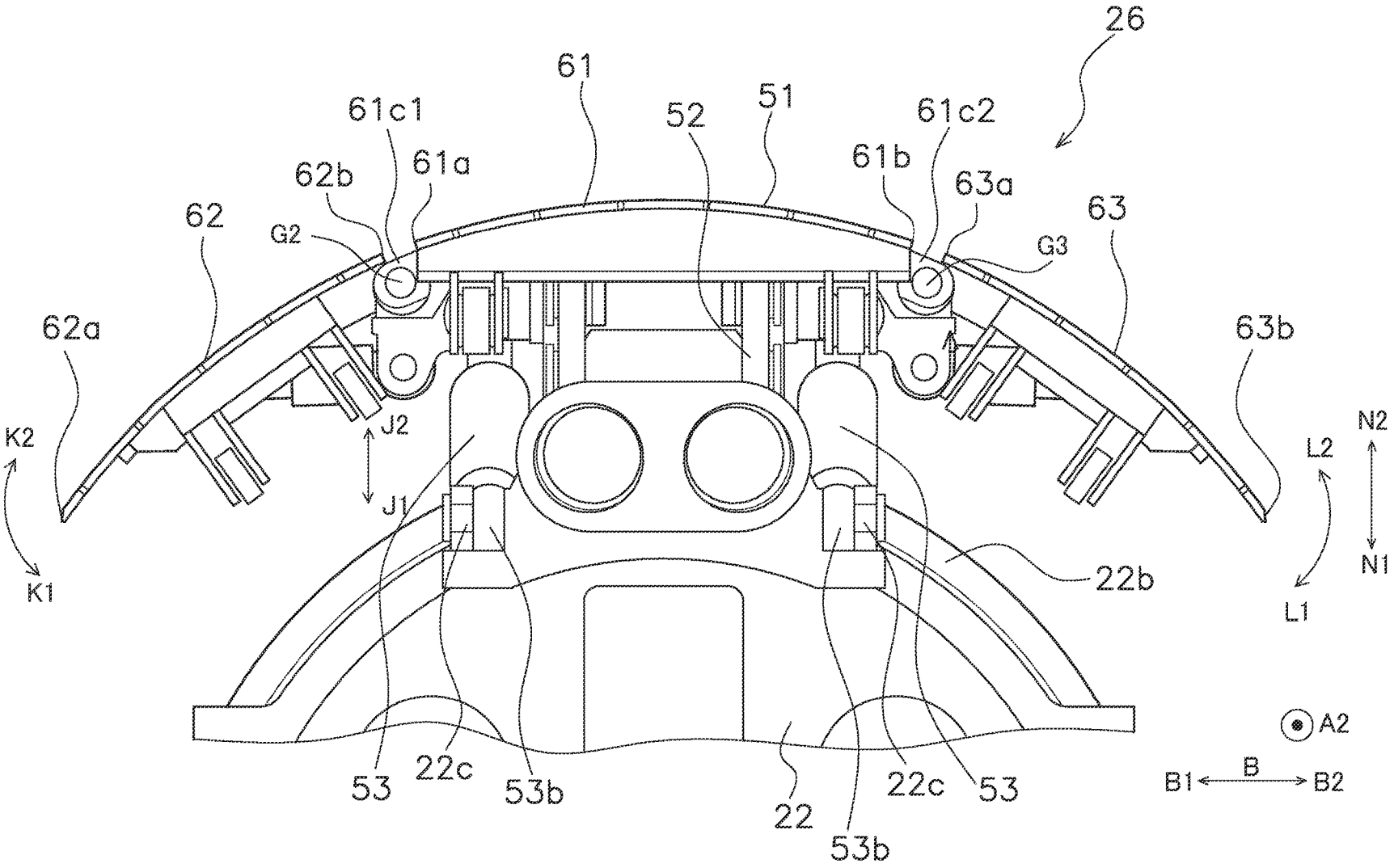
FIG. 20 is a cross-sectional view between arrows M and M' in FIG. 19A.

FIG. 18 is a front view of the roof support 26 as seen from the front. FIG. 19A is a bottom view of the roof support 26. FIG. 19B is a cross-sectional view between arrows S and S' in FIG. 19A. FIG. 20 is a cross-sectional view between arrows M and M' in FIG. 19A.

The roof support 26 has a roof shoe 51, a parallel link 52, and hydraulic cylinders 53 as illustrated in FIG. 18.

The roof shoe 51 is disposed so as to cover the cutter head support 22 from above as illustrated in FIG. 1A and FIG. 2. The roof shoe 51 is curved to protrude outward as seen along the front-back direction A. The above-mentioned vertical shoe 34 of the vertical support 23, the side shoe 41 of the side support 24, the side shoe 41 of the side support 25, and the roof shoe 51 are disposed so as to form a circle as seen along the front-back direction A.

The parallel link 52 couples the roof shoe 51 and an upper section 22*b* of the cutter head support 22. The parallel link 52 (example of a second link section) has two coupling members 521 as illustrated in FIG. 19A and FIG. 19B. The two coupling members 521 are disposed along the front-back direction A. Each of the coupling members 521 forms an H shape as seen from the front. Two first ends 521*a* on the upper ends of the H shape in each coupling member 521 are turnably attached to the roof shoe 51. Two second ends 521*b* that are the lower ends of the H shape of each coupling member 521 are turnably coupled to the upper section 22*b* of the cutter head support 22. A turning shaft in each of the first ends 521*a* and the second ends 521*b* of each coupling member 521 is provided in the B direction. The second ends 521*b* of each of the coupling members 521 are disposed further toward the front than the first ends 521*a*.

The hydraulic cylinders 53 move the roof shoe 51 in a direction approaching the cutter head support 22 or in a direction away from the cutter head support 22. Two hydraulic cylinders 53 are provided and are disposed at both outer sides in the width direction B of the parallel link 52. Each of the hydraulic cylinders 53 are disposed approximately parallel to a vertical plane. The hydraulic cylinders 53 each have a cylinder and a rod that is connected to a piston disposed inside the cylinder.

Coupling sections 51*a* are provided inside the roof shoe 51 as illustrated in FIG. 18 and a first end 53*a* on the rod side of each hydraulic cylinder 53 is rotatably attached to the coupling section 51*a*. Coupling sections 22*c* are provided to the upper section 22*b* of the cutter head support 22 and a second end 53*b* on the cylinder side of each hydraulic cylinder 53 is rotatably attached to the coupling section 22*c*. The first ends 53*a* are disposed further toward the front than the second ends 53*b*. Rotating shafts of the first end 53*a* and the second end 53*b* of each hydraulic cylinder 53 are parallel to the width direction B. In addition, the hydraulic cylinders 53 are disposed so as to intersect the parallel link 52 as seen in a side view.

When the hydraulic cylinders 52 contract, the first ends 521*a* of the coupling members 521 of the parallel link 52 turn about the second ends 521*b* toward the upper section 22*b* (see arrow J1 in FIG. 18). Consequently, the roof shoe 51 moves to the cutter head support 22 side and the diameter of the front body section 11 can be reduced.

Moreover, when the hydraulic cylinders 53 contract, the first ends 521*a* of the coupling members 521 of the parallel link 52 turn about the second ends 521*b* away from the upper section 22*b* (see arrow J2). Consequently, the roof shoe 51 moves away from the cutter head support 22 side and the diameter can be increased.

(Roof Shoe 51)

The roof shoe 51 (example of a collapsing member, example of an upper shoe) has a roof shoe center section 61, a roof shoe left side section 62, a roof shoe right side section 63, hydraulic cylinders 64, and hydraulic cylinders 65 as illustrated in FIG. 18 and FIG. 19A. The roof shoe center section 61 is disposed in the center in the width direction B of the roof shoe 51. The parallel link 52 and the hydraulic cylinder 64 are coupled to the roof shoe center section 61.

The roof shoe left side section 62 is disposed on the left side (B1 direction side) of the roof shoe center section 61. A right end 62*b* of the roof shoe left side section 62 is coupled to the left end 61*a* of the roof shoe center section 61. The roof shoe left side section 62 is configured so that a left end 62*a* is able to turn in the up-down direction about a coupling section 62*c* with the roof shoe center section 61 (see arrows K1 and K2).

A coupling section 61*c*1 is provided on the inside to the left end 61*a* of the roof shoe center section 61. The coupling section 62*c* is provided on the inside to the right end 62*b* of the roof shoe left side section 62. The coupling section 61*c*1 and the coupling section 62*c* are each formed with a through-hole along the front-back direction A, and a shaft member is inserted into each of the through-holes. Consequently, the left end 62*a* of the roof shoe left side section 62 is able to turn about a coupling shaft G2 along the front-back direction A in a direction approaching (arrow K1) and a direction away from (arrow K2) the cutter head support 22 with respect to the roof shoe center section 61.

The hydraulic cylinders 64 are disposed straddling the roof shoe center section 61 and the roof shoe left side section 62. As illustrated in FIG. 19A, two hydraulic cylinders 64 are disposed side by side in the front-back direction A. The hydraulic cylinders 64 are each disposed along the width direction B. The hydraulic cylinders 64 each have a cylinder and a rod that is connected to a piston disposed inside the cylinder. As illustrated in FIG. 18, coupling sections 62*d* are provided near the center in the width direction B of the roof shoe left side section 62 and a first end 64*a* on the rod side of each hydraulic cylinder 64 is turnably attached to the coupling section 62*d*. Coupling sections 61*d*1 are provided inside near the left end 61*a* of the roof shoe center section 61, and a second end 64*b* on the cylinder side of each hydraulic cylinder 64 is rotatably attached to the coupling section 61*d*1. The first end 64*a* and the second end 64*b* of each hydraulic cylinder 64 are able to turn about an axis in the front-back direction A.

When the hydraulic cylinders 64 contract, the coupling section 62*d* coupled to the first end 64*a* turns toward the arrow K1 in FIG. 18 whereby the left end 62*a* of the roof shoe left side section 62 turns in the direction of the arrow K1 about the coupling shaft G1. Consequently, the left end 62*a* of the roof shoe left side section 62 is able to move to the inside (in the direction approaching the cutter head support 22).

When the hydraulic cylinders 64 extend, the coupling section 62*d* coupled to the first end 64*a* turns in the direction of the arrow K2 whereby the left end 62*a* of the roof shoe left side section 62 turns in the direction of the arrow K2 about the coupling shaft G2. Consequently, the left end 62*a* of the roof shoe left side section 62 is able to move to the outside (in the direction away from the cutter head support 22).

The roof shoe right side section 63 is disposed on the right side (B2 direction side) of the roof shoe center section 61. A right end 61*b* of the roof shoe center section 61 is coupled to a left end 63*a* of the roof shoe right side section 63. The roof shoe right side section 63 is configured so that a right end 63*b* is able to turn in the up-down direction about a coupling section 63*c* with the roof shoe center section 61 (see arrows L1 and L2).

A coupling section 61*c*2 is provided on the inside to the right end 61*b* of the roof shoe center section 61. The coupling section 63*c* is provided on the inside to the left end 63*a* of the roof shoe right side section 63. The coupling section 61*c*2 and the coupling section 63*c* are each formed with a through-hole along the front-back direction A, and a shaft member is inserted into each of the through-holes. Consequently, the right end 63*a* of the roof shoe right side section 63 is able to turn about a coupling shaft G3 along the front-back direction A in a direction approaching (arrow L1) and a direction away from (arrow L2) the cutter head support 22 with respect to the roof shoe center section 61.

The hydraulic cylinders 65 are disposed straddling the roof shoe center section 61 and the roof shoe right side section 63. As illustrated in FIG. 19A, two hydraulic cylinders 65 are disposed side by side in the front-back direction A. The hydraulic cylinders 65 are each disposed along the width direction B. The hydraulic cylinders 65 each have a cylinder and a rod that is connected to a piston disposed inside the cylinder. Coupling sections 63*d* are provided near the center in the width direction of the roof shoe right side section 63 as illustrated in FIG. 18, and a first end 65*a* on the rod side of each hydraulic cylinder 65 is rotatably attached to the coupling section 63*d*. Coupling sections 61*d*2 are provided on the inside near the right end 61*b* of the roof shoe center section 61 and the second end 65*b* on the cylinder side of each hydraulic cylinder 65 is rotatably attached to the coupling section 61*d*2. The first end 65*a* and the second end 65*b* of each hydraulic cylinder 65 are able to turn about an axis in the front-back direction A.

When the hydraulic cylinders 65 contract, the coupling sections 63*d* coupled to the first ends 65*a* turn toward the arrow L1 and therefore the right end 63*b* of the roof shoe right side section 63 turns in the direction of the arrow L1 about the coupling shaft G3. Consequently, the right end 63*b* of the roof shoe right side section 63 is able to move to the inside (in the direction approaching the cutter head support 22).

When the hydraulic cylinders 65 extend, the coupling sections 63*d* coupled to the first ends 65*a* turn toward the arrow L2 and therefore the right end 63*a* of the roof shoe right side section 63 turns in the direction of the arrow L2 about the coupling shaft G3. Consequently, the right end 63*b* of the roof shoe right side section 63 is able to move to the outside (in the direction away from the cutter head support 22).

(Roof Shoe Center Section 61)

As illustrated in FIG. 19A and FIG. 19B, the roof shoe center section 61 has a roof shoe center front section 611 and a roof shoe center rear section 612.

The parallel link 52, the hydraulic cylinders 53, the hydraulic cylinders 64, and the hydraulic cylinders 65 are coupled to the roof shoe center front section 611. The roof shoe center rear section 612 is disposed to the rear of the roof shoe center front section 611. A rear end 611*a* of the roof shoe center front section 611 is coupled to a front end 612*b* of the roof shoe center rear section 612. The roof shoe center rear section 612 is configured so that a rear end 612*a* is able to turn in the up-down direction about a coupling section 612*c* with the roof shoe center front section 611 (toward the front and toward the back of the sheet in FIG. 19A and the directions of arrows N1 and N2 in FIG. 19B). A plurality of notches are formed in the roof shoe center rear section 612 from the rear end 612*a* thereof in the forward direction A1 as illustrated in FIG. 1A.

A coupling section 611*c* is provided on the inside to the rear end 611*a* of the roof shoe center front section 611. The coupling section 612*c* is provided on the inside to a front end 612*b* of the roof shoe center rear section 612. The coupling section 611*c* and the coupling section 612*c* are each formed with a through-hole along the width direction B, and a shaft member is inserted into each of the through-holes. Consequently, the rear end 612*a* of the roof shoe center rear section 612 is able to turn about a coupling shaft G4 in the width direction B in the direction approaching (see direction toward the front of the sheet in FIG. 19A, the direction of arrow N1 in FIG. 19B, and arrow J1 in FIG. 20) and in the direction away from (see direction toward the back of the sheet in FIG. 19A, the direction of arrow N2 in FIG. 19B, and arrow J2 in FIG. 20) the cutter head support 22.

In addition, hydraulic cylinders 66 are disposed straddling the roof shoe center front section 611 and the roof shoe center rear section 612 so that the rear end 612*a* of the roof shoe center rear section 612 turns about the coupling shaft G4.

For example, two hydraulic cylinders 66 are disposed along the width direction B. The hydraulic cylinders 66 are each disposed along the front-back direction A. The hydraulic cylinders 66 each have a cylinder and a rod that is connected to a piston disposed inside the cylinder. Coupling sections 612*d* are provided on the inside near the front end 612*b* of the roof shoe center rear section 612. A first end 66*a* on the rod side of each hydraulic cylinder 66 is rotatably attached to each coupling section 612*d*.

As illustrated in FIG. 19B, coupling sections 611*d* are provided inside near the rear end 611*a* of the roof shoe center front section 611, and a second end 66*b* on the cylinder side of each hydraulic cylinder 66 is turnably attached to the coupling section 611*d*. Turning centers of the first end 66*a* and the second end 66*b* of each hydraulic cylinder 66 are approximately parallel to the width direction B.

When the hydraulic cylinders 66 contract, the coupling section 612*d* coupled to the first end 66*a* turns in the direction toward the front of the sheet whereby the rear end 612*a* of the roof shoe center rear section 612 turns in the direction toward the front of the sheet about the shaft G4. Consequently, the rear end 612*a* of the roof shoe center rear section 612 is able to move to the inside (in the direction approaching the cutter head support 22) (see direction N1 in FIG. 19B and FIG. 20).

When the hydraulic cylinders 66 extend, because the coupling section 612*d* coupled to the first end 66*a* turns in the direction toward the back of the sheet, the rear end 612*a* of the roof shoe center rear section 612 turns in the direction toward the back of the sheet about the coupling shaft G4. Consequently, the rear end 612*a* of the roof shoe center rear section 612 is able to move to the outside (in the direction away from the cutter head support 22) (see direction N2 in FIG. 19B and FIG. 20).

(Roof Shoe Left Side Section 62)

The roof shoe left side section 62 has a roof shoe left side front section 621 and a roof shoe left side rear section 622 as illustrated in FIG. 19A.

The roof shoe left side front section 621 is coupled to the roof shoe center front section 611 and the hydraulic cylinders 64 are coupled to the roof shoe left side front section 621.

The roof shoe left side rear section 622 is disposed on the rear side of the roof shoe left side front section 621. A front end 622*b* of the roof shoe left side rear section 622 is coupled to a rear end 621*a* of the roof shoe left side front section 621. The roof shoe left side rear section 622 is configured so that a rear end 622*a* is able to turn in the up-down direction about the center of a coupling section 622*c* with the roof shoe left side front section 621 (toward the front of the sheet and toward the back of the sheet in FIG. 19A). A plurality of notches are formed in the roof shoe left side rear section 622 from the rear end 622*a* thereof in the forward direction A1 as illustrated in FIG. 1A.

A coupling section 621*c* is provided on the inside to the rear end 621*a* of the roof shoe left side front section 621. The coupling section 622*c* is provided on the inside to the front end 622*b* of the roof shoe left side rear section 622. The coupling section 621*c* and the coupling section 622*c* are each formed with a through-hole along the width direction B, and a shaft member is inserted into each of the through-holes. Consequently, the rear end 622*a* of the roof shoe left side rear section 622 is able to turn about the coupling shaft G4 in a direction approaching (direction toward the front of the sheet in FIG. 19A) and a direction away from (direction toward the back of the sheet in FIG. 19A) the cutter head support 22 with respect to the roof shoe left side front section 621.

In addition, hydraulic cylinders 67 for allowing the rear end 622*a* of the roof shoe left side rear section 622 to turn about the shaft G4 are disposed straddling the roof shoe left side front section 621 and the roof shoe left side rear section 622.

For example, two hydraulic cylinders 67 are disposed along the width direction B. The hydraulic cylinders 67 are each disposed along the front-back direction A. The hydraulic cylinders 67 each have a cylinder and a rod that is connected to a piston disposed inside the cylinder. Coupling sections 622*d* are provided on the inside near the front end 622*b* of the roof shoe left side rear section 622. A first end 67*a* on the rod side of each hydraulic cylinder 67 is turnably provided to each coupling section 622*d*.

In addition, coupling sections 621*d* are provided inside near the rear end 621*a* of the roof shoe left side front section 621, and a second end 67*b* on the cylinder side of each hydraulic cylinder 67 is rotatably attached to the coupling section 621*d*. Turning centers of the first end 67*a* and the second end 67*b* of each hydraulic cylinder 67 are approximately parallel to the width direction B.

When the hydraulic cylinders 67 contract, the coupling section 622*d* coupled to the first end 67*a* turns toward the front of the sheet whereby the rear end 622*a* of the roof shoe left side rear section 622 turns in the direction toward the front of the sheet about the shaft G4. Consequently, the rear end 622*a* of the roof shoe left side rear section 622 is able to move to the inside (in the direction approaching the cutter head support 22) (see direction N1 in FIG. 19B and FIG. 20).

When the hydraulic cylinders 67 extend, the coupling section 622*d* coupled to the first end 67*a* turns toward the back of the sheet whereby the rear end 622*a* of the roof shoe left side rear section 622 turns in the direction toward the back of the sheet about the coupling shaft G4. Consequently, the rear end 622*a* of the roof shoe left side rear section 622 is able to move to the outside (in the direction away from the cutter head support 22) (see direction N2 in FIG. 19B and FIG. 20).

(Roof Shoe Right Side Section 63)

The roof shoe right side section 63 has a roof shoe right side front section 631 and a roof shoe right side rear section 632 as illustrated in FIG. 19A.

The roof shoe right side front section 631 is coupled to the roof shoe center front section 611 and the hydraulic cylinders 65 are coupled to the roof shoe right side front section 622.

The roof shoe right side rear section 632 is disposed on the rear side of the roof shoe right side front section 631. A front end 632*b* of the roof shoe right side rear section 632 is coupled to a rear end 631*a* of the roof shoe right side front section 631. The roof shoe right side rear section 632 is configured so that a rear end 632*a* is able to turn in the up-down direction about a coupling section 632*c* with the roof shoe right side front section 631 (in the direction toward the front of the sheet and toward the back of the sheet in FIG. 19A). A plurality of notches are formed in the roof shoe right side rear section 632 from the rear end 632*a* thereof in the forward direction A1 as illustrated in FIG. 1A.

A coupling section 631*c* is provided on the inside to the rear end 631*a* of the roof shoe right side front section 631. The coupling section 632*c* is provided on the inside to the front end 632*b* of the roof shoe right side rear section 632. The coupling section 631*c* and the coupling section 632*c* are each formed with a through-hole along the width direction B, and a shaft member is inserted into each of the through-holes. Consequently, the rear end 632*a* of the roof shoe right side rear section 632 is able to turn about the coupling axis G4 in a direction approaching (direction toward the front of the sheet in FIG. 19A) and a direction away from (direction toward the back of the sheet in FIG. 19A) the cutter head support 22 with respect to the roof shoe right side front section 631.

Hydraulic cylinders 68 for turning the rear end 632*a* of the roof shoe right side rear section 632 about the shaft G4 are disposed straddling the roof shoe right side front section 631 and the roof shoe right side rear section 632.

For example, two hydraulic cylinders 68 are disposed along the width direction B. The hydraulic cylinders 68 are each disposed along the front-back direction A. The hydraulic cylinders 68 each have a cylinder and a rod that is connected to a piston disposed inside the cylinder. A coupling section 632*d* is provided on the inside near the front end 632*b* of the roof shoe right side rear section 632. A first end 68*a* on the rod side of each hydraulic cylinder 68 is turnably provided to the coupling section 632*d*.

In addition, the coupling sections 631*d* are provided inside near the rear end 631*a* of the roof shoe right side front section 631, and a second end 68*b* on the cylinder side of each hydraulic cylinder 68 is turnably attached to the coupling section 631*d*. Turning centers of the first end 68*a* and the second end 68*b* of each hydraulic cylinder 68 are approximately parallel to the width direction B.

When the hydraulic cylinders 68 contract, the coupling section 632*d* coupled to the first end 68*a* turns toward the front of the sheet whereby the rear end 632*a* of the roof shoe right side rear section 632 turns in the direction toward the front of the sheet about the shaft G4. Consequently, the rear end 632*a* of the roof shoe right side rear section 632 is able to move to the inside (in the direction approaching the cutter head support 22) (see direction N1 in FIG. 19B and FIG. 20).

When the hydraulic cylinders 68 extend, the coupling section 632*d* coupled to the first end 68*a* turns toward the back of the sheet whereby the rear end 632*a* of the roof shoe right side rear section 632 turns in the direction toward the back of the sheet about the coupling shaft G4. Consequently, the rear end 632*a* of the roof shoe right side rear section 632 is able to move to the outside (in the direction away from the cutter head support 22) (see direction N2 in FIG. 19B and FIG. 20).

The roof shoe center front section 611, the roof shoe left side front section 621, and the roof shoe right side front section 631 correspond to an example of an upper shoe front section, and the roof shoe center rear section 612, the roof shoe left side rear section 622, and the roof shoe right side rear section 632 correspond to an example of a roof shoe rear section.

(Rear Body Section 12)

Figure 21:
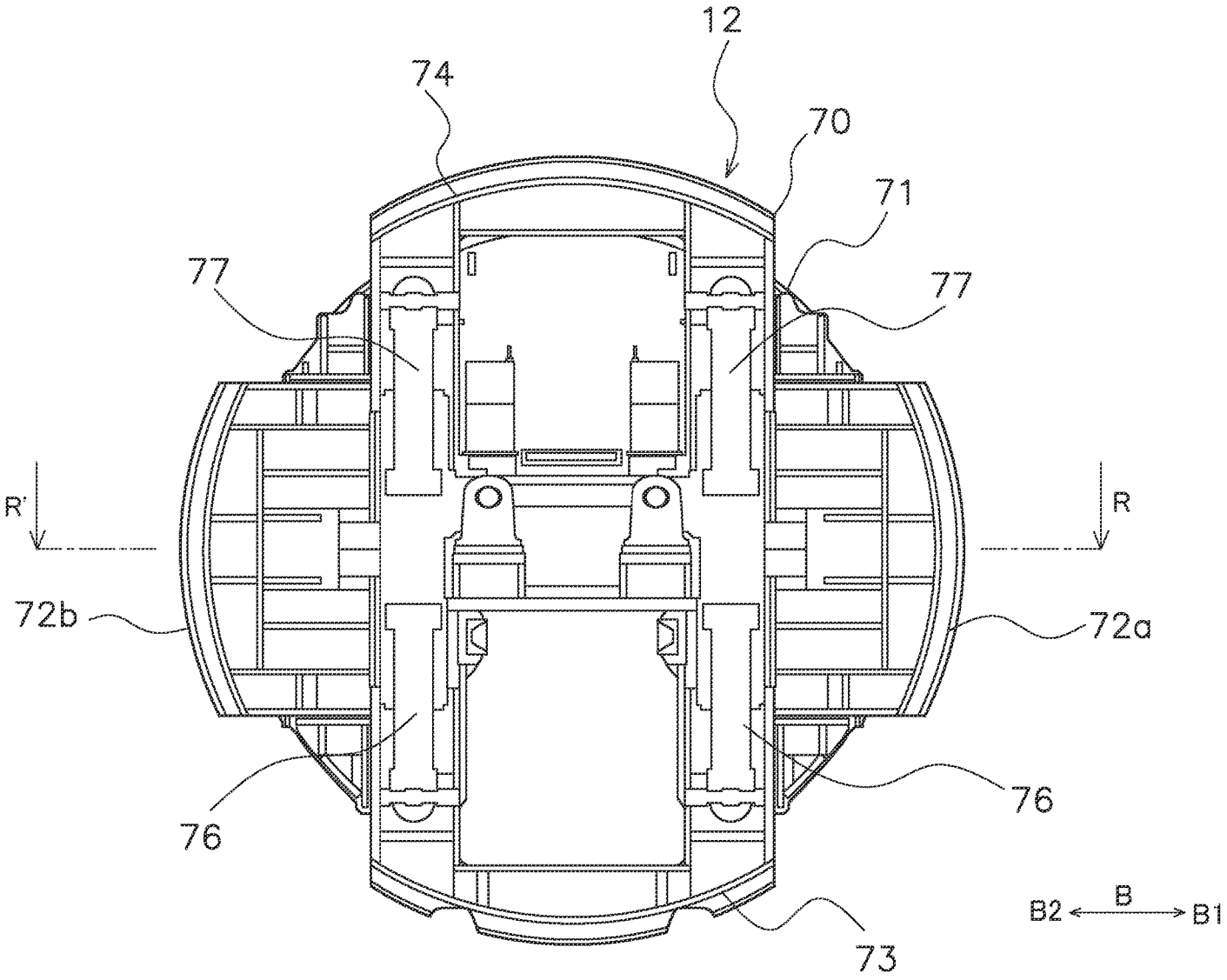
FIG. 21 is a diagram illustrating a configuration of the rear body section of FIG. 1A.
Figure 22:
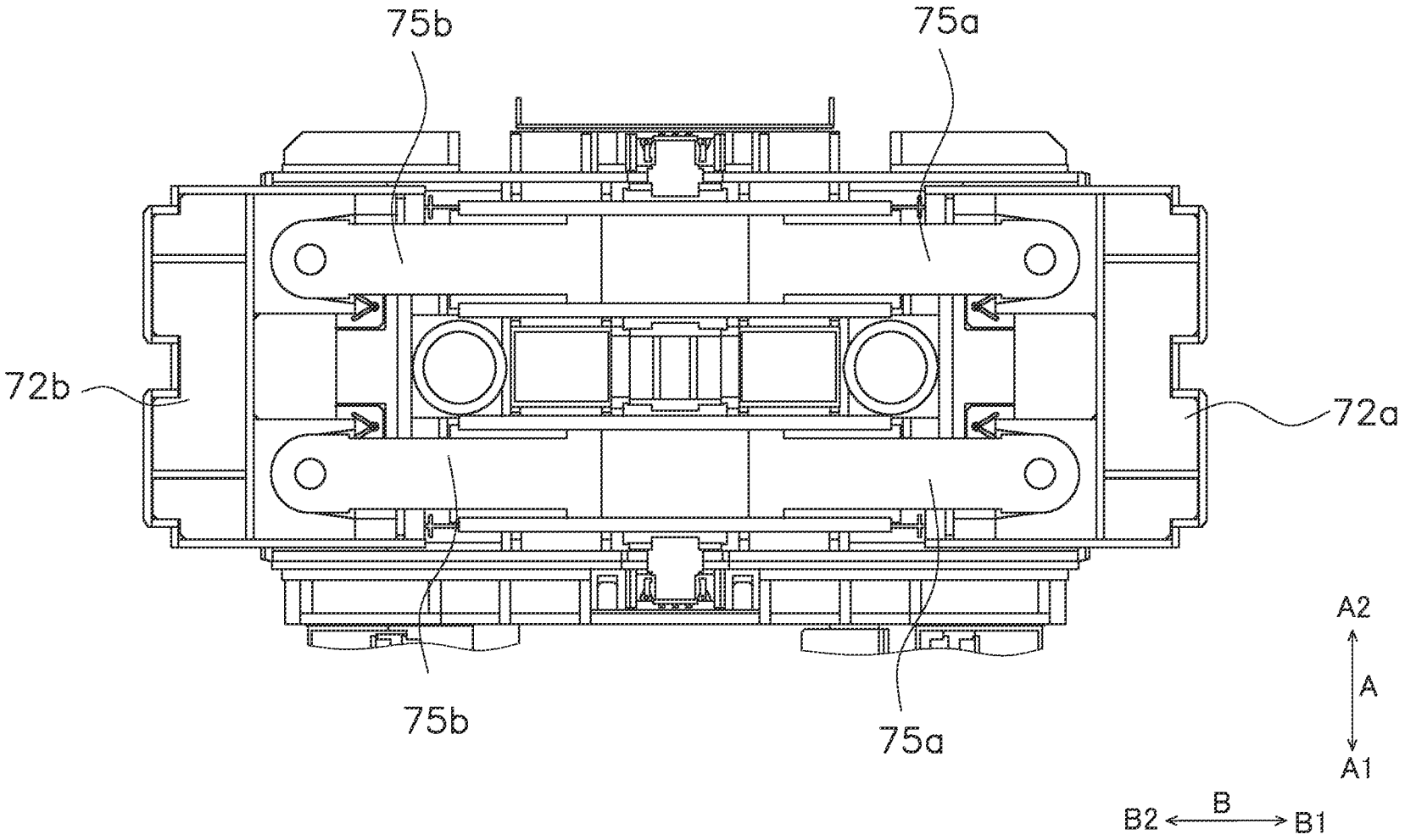
FIG. 22 is a cross-sectional view between arrows R and R' in FIG. 21.

FIG. 21 is a diagram illustrating a configuration of the rear body section 12. FIG. 22 is a cross-sectional view between arrows R and R' in FIG. 21.

The rear body section 12 has the gripper section 70 and a gripper carrier 71 as illustrated in FIG. 1A. The gripper section 70 protrudes to the outside from the gripper carrier 71 and presses the tunnel inner wall when excavating and supports the rear body section 12 against the tunnel inner wall.

The gripper section 70 has a pair of side grippers 72*a* and 72*b*, a lower gripper 73, an upper gripper 74, side gripper cylinders 75*a* and 75*b*, lower gripper cylinders 76, and upper gripper cylinders 77.

The side grippers 72 and 72*b* are provided to a left portion and a right portion of the gripper carrier 71. Two side gripper cylinders 75*a* are disposed side by side in the front-back direction as illustrated in FIG. 22. The side gripper cylinders 75*a* are each disposed along the width direction B. Two side gripper cylinders 75*b* are disposed side by side in the front-back direction as illustrated in FIG. 22. The side gripper cylinders 75*b* are each disposed along the width direction B. The side grippers cylinder 75*a* extend and contract with hydraulic pressure and the side gripper 72*a* moves to the outside or the inside in the width direction B due to the extension and contraction of the side gripper cylinders 75*a*. The side grippers cylinder 75*b* also extend and contract with hydraulic pressure and the side gripper 72*b* moves to the outside or the inside in the width direction B due to the extension and contraction of the side gripper cylinders 75*b*.

The lower gripper 73 is provided to a lower portion of the gripper carrier 71. Two lower gripper cylinders 76 are disposed side by side in the width direction B as illustrated in FIG. 21. The lower gripper cylinders 76 are each disposed along the up-down direction. The lower gripper cylinders 76 extend and contract with hydraulic pressure and the lower gripper 73 moves in the up-down direction due to the extension and contraction of the lower gripper cylinders 76.

In addition, wheels 78 are mounted to the lower gripper 73 as illustrated in FIG. 1A. Recessed sections 73*a* are formed in the lower gripper 73 as illustrated in below-mentioned FIG. 24, and the wheels 78 are disposed in and fitted to the recessed sections 73*a*. Two wheels 78 are disposed along the front-back direction A, and the two wheels 78 are disposed in two rows in the width direction B. Only the respective front side wheels 78 of the left and right rows are illustrated in FIG. 1A. The wheels 78 are disposed further to the inside than the surface of the lower gripper 73 and the wheels 78 are configured so as not to press against the ground when pressure is applied to the ground by the lower gripper 73.

The upper gripper 74 is provided to an upper portion of the gripper carrier 71. Two upper gripper cylinders 77 are disposed side by side in the width direction B as illustrated in FIG. 21. The upper gripper cylinders 77 are each disposed along the up-down direction. The upper gripper cylinders 77 extend and contract with hydraulic pressure and the upper gripper 74 moves in the up-down direction due to the extension and contraction of the upper gripper cylinders 77.

<Operation of Tunnel Excavation Device>

(Excavation)

The tunnel excavation device 1 of the present embodiment causes the side grippers 72, the lower gripper 73, and the upper gripper 74 of the rear body section 12 to extend to the outside so as to be supported by the rear body section 12 against the tunnel inner wall.

The thrust cylinders 13*a* extend, the front body section 11 travels forward with respect to the rear body section 12, and the cutter head 21 performs excavation. During excavation, the roof shoe 51, the vertical shoe 34, and the side shoes 41 slide against the tunnel inner wall and the excavation can be performed in a stable manner.

Next, the main beam 14 is supported upward with hydraulic pressure using the rear support 18 and then the thrust cylinders 13*a* contract and the rear body section 12 travels forward.

By repeating these actions, the tunnel excavation device 1 moves forward while excavating.

(Traveling in Reverse in a Straight Line)

Next, actions while traveling in reverse will be explained.

When traveling in reverse, the diameters of the front body section 11 and the rear body section 12 are reduced. In the front body section 11, all of the peripheral plates 27 are collapsed from the excavating position Q1 to the storage position Q2. All of the buckets 84 are moved from the excavating position P1 to the storage position P2. In addition, the roller cutters 83' of the side surface section 82 are drawn inward and fixed.

Figure 23:
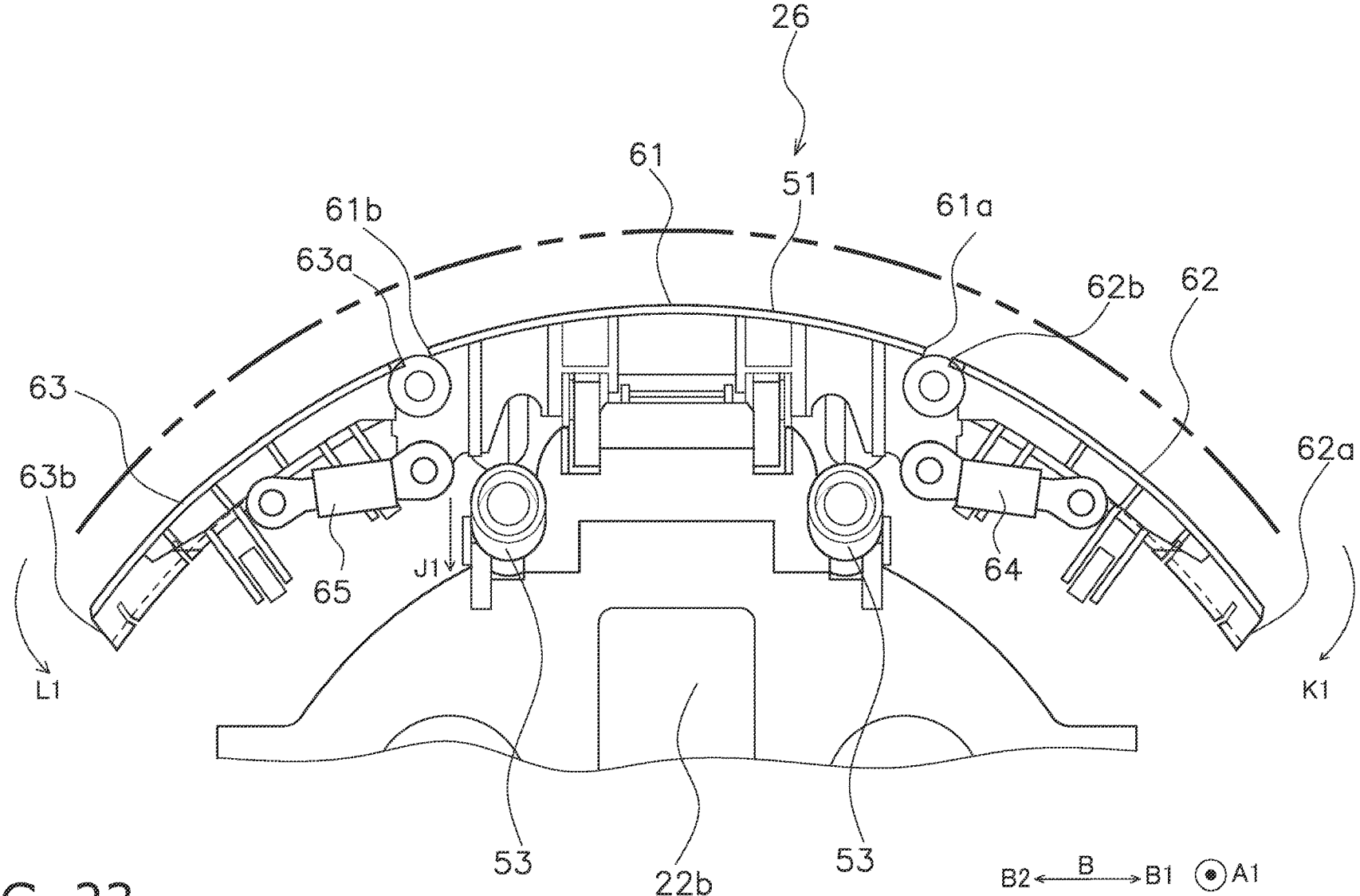
FIG. 23 is a cross-sectional view between arrows V and V' in FIG. 19A.

The diameter of the roof shoe 51 is also reduced. FIG. 23 is a diagram illustrating a state in which the diameter of the roof shoe is reduced and is a cross-sectional view between arrows V and V' in FIG. 19A.

The roof shoe 51 moves downward due to the contraction of the hydraulic cylinders 53 and approaches the cutter head support 22 (see arrow J1). In addition, the hydraulic cylinders 64 contract and the roof shoe left side section 62 is turned so that the left end 62*a* moves downward and approaches the cutter head support 22 (see arrow K1). Moreover, the hydraulic cylinders 65 contract and the roof shoe right side section 63 is turned so that the right end 63*a* moves downward and approaches the cutter head support 22 (see arrow K2). In this way, because the roof shoe 51 is folded in the width direction B, the diameters of the portions of the roof shoe left side section 62 and the roof shoe right side section 63 can also be reduced more than when simply lowering the roof shoe 51, and the entire diameter around the circumference of the roof shoe 51 can be reduced.

The pair of side shoes 41 move inward due to the contraction of the hydraulic cylinders 44 and approach the cutter head support 22 (see arrow E1 in FIG. 17A). The vertical shoe 34 also moves upward due to the contraction of the hydraulic cylinders 35 and approaches the cutter head support 22.

The diameter of the rear body section 12 is also reduced. Specifically, the side gripper cylinders 75*a* and 75*b*, the lower gripper cylinders 76, and the upper gripper cylinders 77 are contracted, and the side grippers 72*a* and 72*b*, the lower gripper 73, and the upper gripper 74 move inward with respect to the gripper carrier 71.

Figure 24:
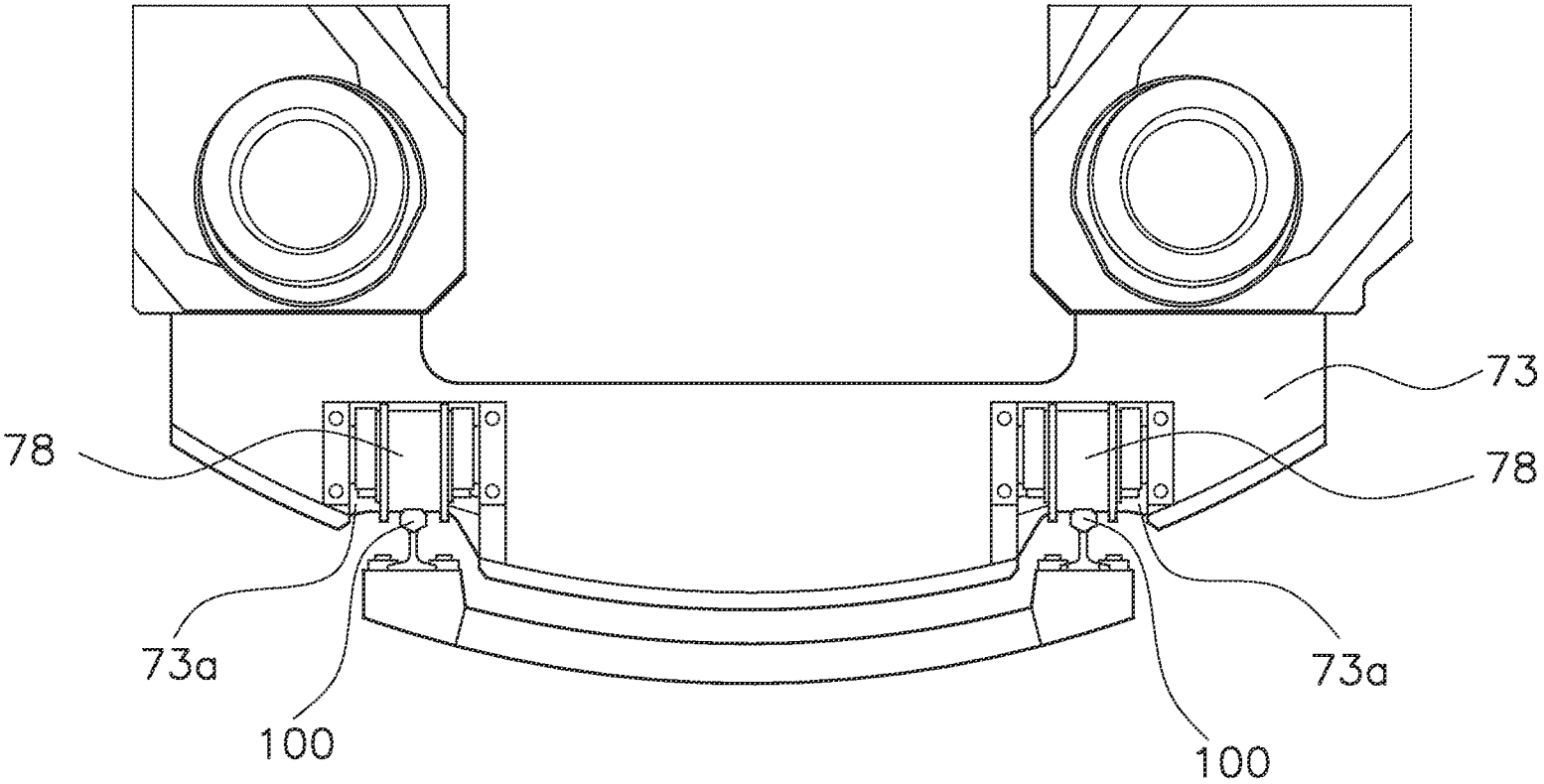
FIG. 24 is a diagram illustrating a state in which the wheels in FIG. 1A are disposed on a rail.

As illustrated in FIG. 24, the wheels 78 mounted to the lower gripper 73 are placed on a rail 100 and the vertical shoe 34 is also placed on the rail 100. The lower gripper 73 and the rail 100 to the rear thereof are connected with the extended hydraulic cylinders. One end of each of the hydraulic cylinders is attached to the lower gripper 73 and the other end is attached to the rail 100 by means of rail clampers. By contracting the hydraulic cylinders attached in this way, the tunnel excavation device 12 can be pulled and made to travel in reverse. After the hydraulic cylinders are contracted as much as possible, the rail clampers are released and, after the hydraulic cylinders have extended, the hydraulic cylinders are re-attached to the rail with the rail clampers and contracted again. By repeating these actions, the entire tunnel excavation device 1 can be made to travel in reverse.

(Moving in Reverse in a Curved Line)

Figure 25:
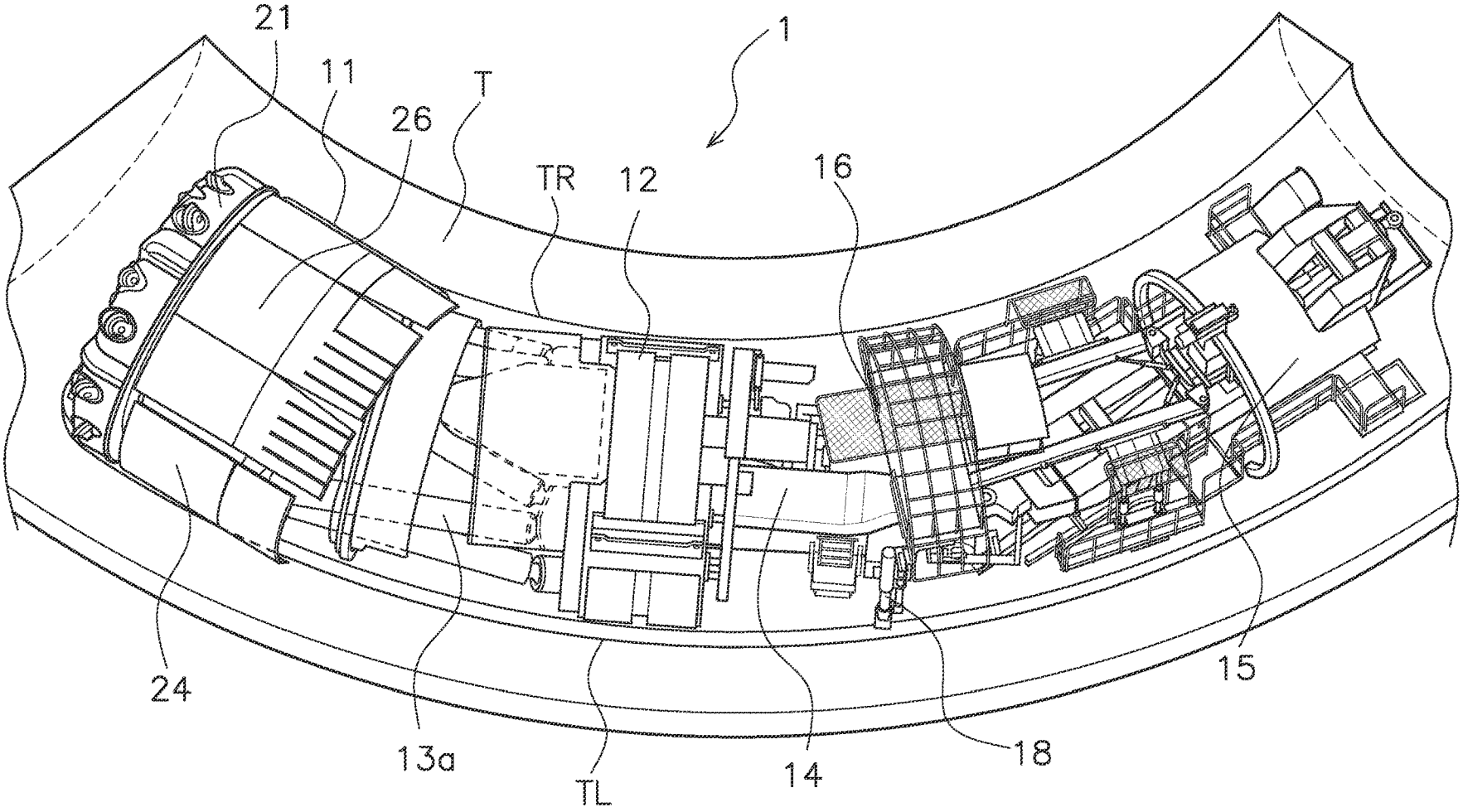
FIG. 25 is a diagram illustrating a state of traveling in reverse along a tunnel constructed in a curved line by the tunnel excavation device of FIG. 1A.

A situation in which the tunnel excavation device 1 of the present embodiment travels in reverse in a curved line will be explained as illustrated in FIG. 25.

Figure 26:
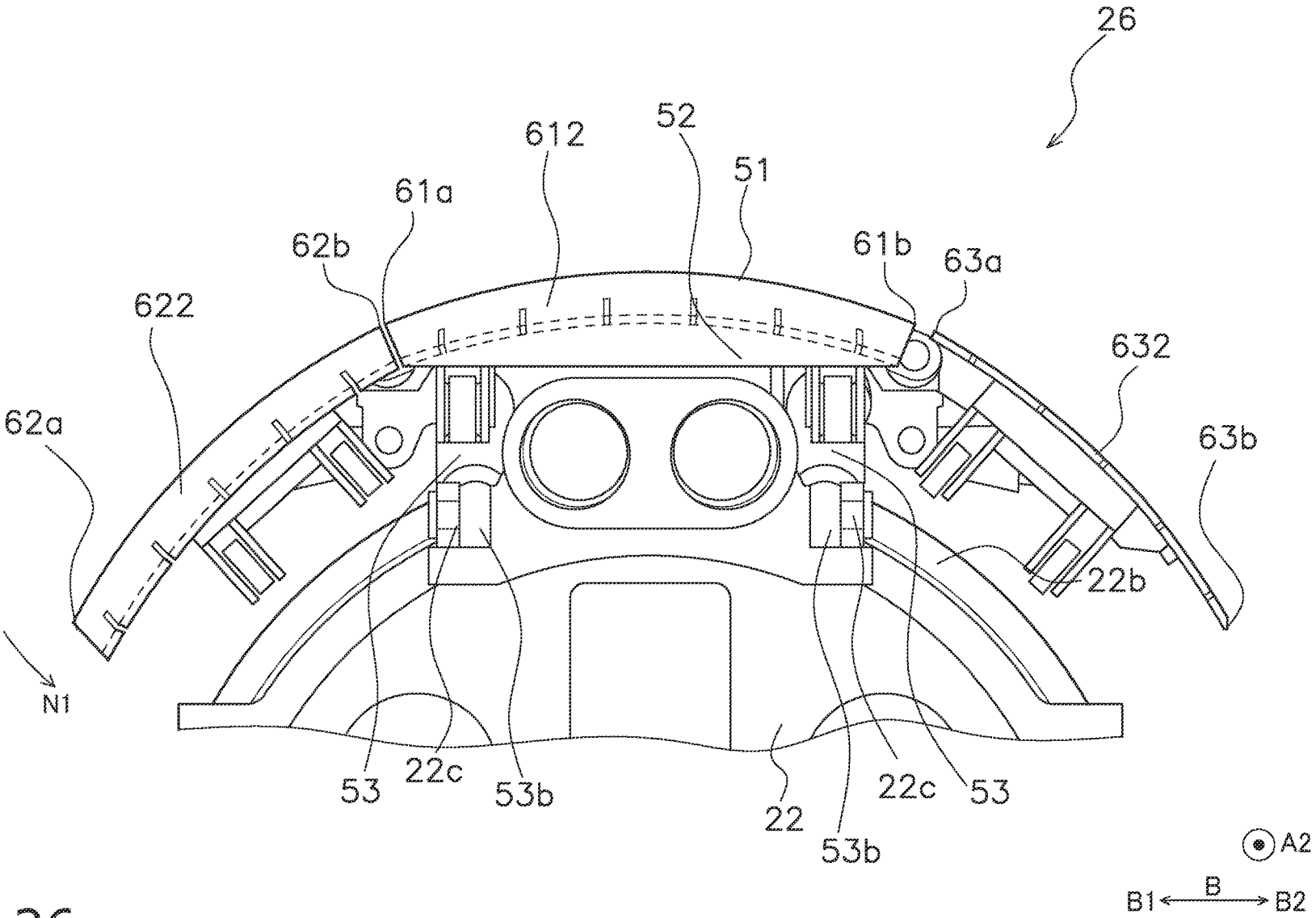
FIG. 26 is a cross-sectional view between arrows M and M' in FIG. 19A.

In FIG. 25, the rear body section 12 is curved to the left in the reverse travel direction with respect to the front body section 11. In this case, not only are the above-mentioned hydraulic cylinders 53, 64, and 65 of the roof shoe 51 contracted, but also the rear sections of the roof side section on the curve outer circumferential side are turned downward. In the example illustrated in FIG. 24, the roof shoe left side section 62 among the roof shoe left side section 62 and the roof shoe right side section 63 serves as the external diameter side because of the left turn. As a result, the hydraulic cylinders 68 are contracted so that the rear end 622*a* of the roof shoe left side rear section 622 of the roof shoe left side section 62 turns downward as illustrated in FIG. 26 (see arrow N1). FIG. 26 is a cross-sectional view between arrows M and M' in FIG. 19A. As illustrated in FIG. 26, the rear end 632*a* of the roof shoe right side rear section 632 of the roof shoe right side section 63 on the curve internal diameter side is not turned toward the cutter head support 22 so that the roof shoe right side rear section 632 does not interfere with another device in the machine.

In addition, the vertical shoe 34 turns along the curve accompanying the reverse travel of the tunnel excavation device 1. The vertical shoe 34 rotates anticlockwise in FIG. 15 in order to bend toward the left in FIG. 25.

As illustrated in FIG. 2, the side shoe rear section 412 of the side shoe 41 on the outside of the curve is turned about the coupling shaft G1 so as to move the rear end 412*b* thereof inward (direction of arrow F1). Consequently, interference by the side support 24 on the outer circumferential side when curving on the tunnel pit wall can be prevented.

In FIG. 2, a right side inner wall TR and a left side inner wall TL of the tunnel T1 are depicted with dashed lines.

The operation of the hydraulic cylinders 33, 44, 53, and 64 to 68 that drive the vertical support 23, the side supports 24 and 25, and the roof support 26 may all or partially be performed automatically with a controller, or may be operated by a worker. The controller has a processor and a memory and the operation is performed automatically by the processor executing a program in the memory.

The tunnel excavation device 1 of the present embodiment has the front body section 11 and the rear body section 12. The front body section 11 has the cutter head 21, the cutter head support 22 (example of a cutter head support section) and the peripheral plates 27 (example of a collapsing section), the roof shoe 51 (example of a collapsing section), or the side shoe 41 (example of a collapsing section). The cutter head 21 has a plurality of roller cutters 83 (example of cutters). The cutter head support 22 supports the cutter head 21. The peripheral plates 27, the roof shoe 51, and the side shoes 41 are provided to the outer circumference and can be collapsed inward. The rear body section 12 is disposed to the rear of the front body section 11. The rear body section 12 has the gripper section 70. The gripper section 70 obtains a reaction force for performing excavation.

By collapsing the collapsing sections provided to the outer circumference in this way, the outer diameters of the collapsing portions can be reduced.

As a result, reverse travel is made possible even when the diameter of the tunnel is smaller due to construction after the excavation.

In addition, because it is thought that curve construction is performed when forming a pit mine, there is a need to travel in a curved line in addition to traveling in a straight line when traveling in reverse. As a result, while there may be interference with the tunnel when traveling in reverse in a curved line even when the diameter of the tunnel is reduced, the interference with the tunnel is eliminated due to the collapsing and reverse travel is made possible.

The peripheral plates 27 (example of circumferential edge plates) are provided to the tunnel excavation device 1 of the present embodiment. The peripheral plates 27 are disposed on the circumferential edge of the cutter head 21. The peripheral plates 27 are coupled to the side surface section 82 (example of side surface) of the cutter head 21 in a collapsible manner via the hinge sections 28 (example of coupling section).

By collapsing the peripheral plates 27 provided to the outer circumference of the cutter head 21 inwardly in this way, the outer diameter of the cutter head 21 can be reduced.

As a result, reverse travel is made possible even when the diameter of the tunnel is smaller due to construction after the excavation.

The side shoes 41 (example of lateral shoe) disposed lateral to the cutter head support 22 are provided to the tunnel excavation device 1 of the present embodiment. The side shoes 41 each have the side shoe front section 411 (example of a lateral shoe front section) and the side shoe rear section 412 (example of a lateral shoe rear section). The side shoe front section 411 is connected to the cutter head support 22. The side shoe rear section 412 is disposed to the rear of the side shoe front section 411 and is coupled in a turnable manner to the side shoe front section 411. The side shoe rear section 412 is configured so that the rear end 412*b* of the side shoe rear section 412 is able to turn horizontally about the coupling section 412*c* with the side shoe front section 411.

In addition, because it is thought that curve construction is performed when forming a pit mine, there is a need to travel in a curved line in addition to traveling in a straight line when traveling in reverse. However, the side shoe rear section 412 of the side shoe 41 on the outer circumferential side of the curve can be collapsed so that the rear end 412*b* moves inward.

According to such a configuration, interference by the side shoe 41 with the tunnel inner wall can be prevented and travel in reverse in a curved line is made possible.

The tunnel excavation device 1 of the present embodiment has the parallel link 43 (example of a first link section). The parallel link 43 couples the cutter head support 22 to the side shoe 41 and the side shoe 41 is able to move in the direction E1 approaching the cutter head support 22 and in the direction E2 away from the cutter head support 22.

According to such a configuration, the diameter of the front body section 11 can be reduced due to the side shoe 41 approaching the cutter head support 22, and therefore reverse travel is made possible even when the inner diameter of the tunnel is smaller due to construction after the excavation.

The roof shoe 51 (example of an upper shoe) disposed above the cutter head support 22 is provided to the tunnel excavation device 1 of the present embodiment. The roof shoe 51 has the roof shoe center section 61 (example of an upper shoe center section), and the roof shoe left side section 62 (example of an upper shoe side section) and the roof shoe right side section 63 (example of a roof shoe side section). The roof shoe left side section 62 and the roof shoe right side section 63 are disposed laterally in the width direction B of the roof shoe center section 61, and are turnably coupled to the roof shoe center section 61. The roof shoe left side section 62 and the roof shoe right side section 63 are configured so that the left end 62*a* (example of an end on the outside) of the roof shoe left side section 62 and the right end 63*a* (example of an end on the outside) of the roof shoe right side section 63 are able to turn in the up-down direction about the coupling sections 62*c* and 63*c* with the roof shoe center section 61.

According to such a configuration, when traveling in reverse along a curved line, the roof shoe side section on the outer circumferential side of the curve among the roof shoe left side section 62 and the roof shoe right side section 63 can collapse with respect to the roof shoe center section 61 so that the ends on the outside move inward.

As a result, interference by the roof shoe 51 with the tunnel inner wall can be prevented and travel in reverse along a curved line is made possible.

The roof shoe 51 disposed above the cutter head support 22 is provided to the tunnel excavation device 1 of the present embodiment. The roof shoe 51 has the roof shoe center front section 611, the roof shoe left side front section 621, and the roof shoe right side front section 631 (example of upper shoe front section), and the roof shoe center rear section 612, the roof shoe left side rear section 622, and the roof shoe right side rear section 632 (example of roof shoe rear section). The roof shoe center front section 611 is connected to the cutter head support 22. The roof shoe center rear section 612, the roof shoe left side rear section 622, and the roof shoe right side rear section 632 are respectively disposed on the rear side of the roof shoe center front section 611, the roof shoe left side front section 621, and the roof shoe right side front section 631 and are respectively coupled in a turnable manner to the roof shoe center front section 611, the roof shoe left side front section 621, and the roof shoe right side front section 631. The roof shoe center rear section 612, the roof shoe left side rear section 622, and the roof shoe right side rear section 632 are configured so that the respective rear ends 612*a*, 622*a*, and 632*a* of the roof shoe center rear section 612, the roof shoe left side rear section 622, and the roof shoe right side rear section 632 are respectively able to turn in the up-down direction about the respective coupling sections 612*c*, 622*c*, and 623*c* with the roof shoe center front section 611, the roof shoe left side front section 621, and the roof shoe right side front section 631.

According to such a configuration, the respective rear ends 612*a*, 622*a*, and 632*a* of the roof shoe center rear section 612, the roof shoe left side rear section 622, and the roof shoe right side rear section 632 can be collapsed so as to move inwardly when traveling in reverse in a tunnel that is formed in a curved shape sloping downward.

As a result, interference by the roof shoe 51 with the tunnel inner wall can be prevented and travel in reverse in a tunnel that slopes downward in a curved line is made possible.

The front body section 11 in the tunnel excavation device 1 of the present embodiment further has a parallel link 523 (example of a second link section). The parallel link 52 couples the cutter head support 22 to the roof shoe 51 and is able to move the roof shoe 51 in the direction J1 approaching the cutter head support 22 and in the direction J2 away from the cutter head support 22.

According to such a configuration, the diameter of the front body section 11 can be reduced due to the roof shoe 51 approaching the cutter head support 22, and therefore reverse travel is made possible even when the inner diameter of the tunnel is smaller due to construction after the excavation.

The roof shoe center section 61 in the tunnel excavation device 1 of the present embodiment has the roof shoe center front section 611 (example of an upper shoe center front section) and the roof shoe center rear section 612 (example of an upper shoe center rear section). The roof shoe center front section 611 is connected to the cutter head support 22. The roof shoe center rear section 612 is disposed to the rear of the roof shoe center front section 611 and is coupled in a turnable manner to the roof shoe center front section 611. The roof shoe center rear section 612 is configured so that the rear end 612*a* of the roof shoe center rear section 612 is able to turn in the up-down direction about the coupling section 612*c* with the roof shoe center front section 611.

According to such a configuration, the rear end 612*a* of the roof shoe center rear section 612 can be collapsed so as to move inwardly (downward) when traveling in reverse in a tunnel that is formed in a curved shape sloping downward.

As a result, interference by the roof shoe center section 61 with the tunnel inner wall can be prevented and reverse travel inside the tunnel that slopes downward in a curved line is made possible.

The roof shoe left side section 62 (example of an upper shoe side section) in the tunnel excavation device 1 of the present embodiment has the roof shoe left side front section 621 (example of an upper shoe side front section) and the roof shoe left side rear section 622 (example of an upper shoe side rear section). The roof shoe left side front section 621 is connected to the roof shoe center section 61 (example of the upper shoe center section). The roof shoe left side rear section 622 is disposed on the rear side of the roof shoe left side front section 621 and is coupled in a turnable manner to the roof shoe left side front section 621. The roof shoe left side rear section 622 is configured so that the rear end 622*a* of the roof shoe left side rear section 622 is able to turn in the up-down direction about the coupling section 622*c* with the roof shoe left side front section 621. The roof shoe right side section 63 (example of an upper shoe side section) has the roof shoe right side front section 631 (example of an upper shoe side front section) and the roof shoe right side rear section 632 (example of an upper shoe side rear section). The roof shoe right side front section 631 is connected to the roof shoe center section 61 (example of the upper shoe center section). The roof shoe right side rear section 632 is disposed on the rear side of the roof shoe right side front section 631 and is coupled in a turnable manner to the roof shoe right side front section 631. The roof shoe right side rear section 632 is configured so that the rear end 632*a* of the roof shoe right side rear section 632 is able to turn in the up-down direction about the coupling section 632*c* with the roof shoe right side front section 631.

According to such a configuration, the respective rear ends 622*a* and 632*a* of the roof shoe center rear section 622 and the roof shoe right side rear section 632 can be collapsed so as to move inwardly (downward) when traveling in reverse in a tunnel that is formed in a curved shape sloping downward.

As a result, interference by the roof shoe left side rear section 622 and the roof shoe right side rear section 632 with the tunnel inner wall can be prevented and reverse travel inside the tunnel that slopes downward in a curved line is made possible.

The front body section 11 in the tunnel excavation device 1 of the present embodiment further has the vertical shoe 34 (example of an lower shoe) and the hydraulic cylinder 33 (example of an actuator). The vertical shoe 34 is disposed below the cutter head support 22. The hydraulic cylinder 33 is able to move the vertical shoe 34 in the direction H1 approaching the cutter head support 22 and in the direction H2 away from the cutter head support 22.

According to such a configuration, a gap between the ground and the vertical shoe 34 can be formed by moving the vertical shoe 34 toward the cutter head support 22 with the hydraulic cylinder 33 and the vertical shoe 34 can be placed on the rail 100. As a result for example, the wheels 78 is disposed below the rear body section 12 and the wheels 78 are disposed on the rail 100 and the rail 100 is connected to the tunnel excavation device 1 by means of the hydraulic cylinder and the like and the tunnel excavation device 1 is able to travel in reverse with hydraulic pressure.

(11)

The vertical shoe 34 in the tunnel excavation device 1 of the present embodiment is provided in a turnable manner to the cutter head support 22. The hydraulic cylinder 33 is disposed at the center of rotation of the vertical shoe 34.

According to such a configuration, the vertical shoe 34 can be turned automatically along the shape of the ground constructed in a curved line when traveling in reverse along the curved line.

(12)

The gripper section 70 in the tunnel excavation device 1 of the present embodiment has the pair of side grippers 72*a* and 72*b* (example of lateral grippers), the lower gripper 73, and the upper gripper 74. The pair of side grippers 72*a* and 72*b* are provided on both sides of the rear body section 12. The lower gripper 73 is provided below the rear body section 12. The upper gripper 74 is provided above the rear body section 12. The wheels 78 are provided below the lower gripper 73.

According to such a configuration, the diameter of the rear body section 12 can be reduced when traveling in reverse. In addition, the wheels 78 are disposed on the rail 100 and the tunnel excavation device 1 is connected to the rail with rail clampers or the like, the rail clampers are extended and contracted with hydraulic pressure, and the tunnel excavation device 1 is able to travel in reverse.

While an embodiment of the present disclosure has been explained above, the present disclosure is not limited to the above embodiment and various changes are possible within the scope of the present disclosure.

While the peripheral plates 27 of the present embodiment are collapsed using the collapsing jig 99, the present invention is not limited in this way and a hydraulic cylinder or a hydraulic jack may be provided and the peripheral plates 27 may be collapsed using hydraulic pressure.

While the storage hydraulic cylinders 89 is carried in and the bucket 84 is moved to the storage position P2 by means of in the present embodiment, the present invention is not limited in this way and a jig configured in the same manner as the above-mentioned collapsing jig 99 may also be used.

While the rear sections of the side shoe 41 and the roof shoe 51 are configured in a turnable manner so that the side shoe 41 and the roof shoe 51 cane be folded, when the length in the front-back direction A is small, the side shoe 41 and the roof shoe 51 may not be configured so as to be folded.

While the upper gripper 74, the side grippers 72 and the lower gripper 73 are provided up and down and left and right to the rear body section 12 in the above embodiment, the present invention is not limited in this way and, for example, only the side grippers 72 may be provided.

While the hydraulic cylinders 44, 53, and 64 to 68 are used in the above embodiment, the present invention is not limited to hydraulic cylinders and may be jacks or the like.

While the above embodiment describes causing the tunnel excavation device 1 to travel in reverse with hydraulic pressure by means of the rail clampers, the present invention is not limited to rail clampers and the tunnel excavation device 1 may be towed by another vehicle or the like.

While an embodiment is disclosed that addresses the purpose of avoiding interference when the tunnel excavation device 1 travels in reverse in a curved line, the present disclosure is also applicable to a sharply curved line section during forward travel.

The tunnel excavation device of the present disclosure demonstrates the effect of being able to travel in reverse and is applicable to pit mining.

What is claimed is:

1. A tunnel excavation device comprising:

a front body section including a cutter head including a plurality of cutters, a cutter head support section supporting the cutter head, and a collapsing section provided to an outer circumference of the front body section, the collapsing section being configured to be collapsed toward an inside; and a rear body section including a gripper section for obtaining a reaction force when excavating, the rear body section being disposed to a rear of the front body section, the collapsing section including a circumferential edge plate disposed on a circumferential edge of the cutter head, the circumferential edge plate being coupled to a side surface of the cutter head in a collapsible manner via a coupling section, and the circumferential edge plate being collapsible by rotating about the coupling section from a first position in which the circumferential edge plate protrudes outwardly from the side surface of the cutter head to a second position in which the circumferential edge plate is disposed further inward than the side surface of the cutter head.

2. The tunnel excavation device according to claim 1, wherein the collapsing section includes an upper shoe disposed above the cutter head support section, and the upper shoe includes an upper shoe center section, and an upper shoe side section disposed laterally in a width direction of the upper shoe center section and coupled in a turnable manner to the upper shoe center section, and the upper shoe side section is configured so that an end on an outside of the upper shoe side section is turnable in a vertical direction about a coupling section with the upper shoe center section.

3. The tunnel excavation device according to claim 2, wherein the front body section further includes an upper shoe link section coupling the cutter head support section to the upper shoe and configured to move the upper shoe in a direction approaching the cutter head support section and in a direction away from the cutter head support section.

4. The tunnel excavation device according to claim 2, wherein the upper shoe center section includes an upper shoe center front section connected to the cutter head support section, and an upper shoe center rear section disposed on a rear side of the upper shoe center front section and coupled in a turnable manner to the upper shoe center front section, and the upper shoe center rear section is configured so that a rear end of the upper shoe center rear section is turnable in a vertical direction about a coupling section with the upper shoe center front section.

5. The tunnel excavation device according to claim 2, wherein the upper shoe side section includes an upper shoe side front section connected to upper shoe center section, and an upper shoe side rear section disposed on a rear side of the upper shoe side front section and coupled in a turnable manner to the upper shoe side front section, and the upper shoe side rear section is configured so that a rear end of the upper shoe side rear section is turnable in a vertical direction about a coupling section with the upper shoe side front section.

6. The tunnel excavation device according to claim 5, wherein the front body section further includes a lower shoe disposed below the cutter head support section, and an actuator configured to move the lower shoe in a direction approaching the cutter head support section and in a direction away from the cutter head support section.

7. The tunnel excavation device according to claim 6, wherein the gripper section includes a pair of lateral grippers provided to either side of the rear body section, a lower gripper provided below the rear body section, and an upper gripper provided above the rear body section, and a plurality of wheels are provided below the lower gripper.

8. The tunnel excavation device according to claim 1, wherein the front body section further includes a lower shoe disposed below the cutter head support section, and an actuator configured to move the lower shoe in a direction approaching the cutter head support section and in a direction away from the cutter head support section.

9. The tunnel excavation device according to claim 8, wherein the lower shoe is provided in a turnable manner to the cutter head support section, the actuator is a hydraulic cylinder, and the hydraulic cylinder is disposed at a center of rotation of the lower shoe.

10. The tunnel excavation device according to claim 1, wherein the gripper section includes a pair of lateral grippers provided to either side of the rear body section, a lower gripper provided below the rear body section, and an upper gripper provided above the rear body section, and a plurality of wheels are provided below the lower gripper.

11. The tunnel excavation device according to claim 1, wherein the collapsing section includes a lateral shoe disposed lateral to the cutter head support section, and the lateral shoe includes a lateral shoe front section connected to the cutter head support section, and a lateral shoe rear section disposed on a rear side of the lateral shoe front section and coupled in a turnable manner to the lateral shoe front section, and the lateral shoe rear section is configured so that a rear end of the lateral shoe rear section is turnable in a horizontal direction about a coupling section with the lateral shoe front section.

12. The tunnel excavation device according to claim 11, wherein the front body section further includes a lateral shoe link section coupling the cutter head support section to the lateral shoe and configured to move the lateral shoe in a direction approaching the cutter head support section and in a direction away from the cutter head support section.

13. The tunnel excavation device according to claim 12, wherein the collapsing section includes an upper shoe disposed above the cutter head support section, and the upper shoe includes an upper shoe center section, and an upper shoe side section disposed laterally in a width direction of the upper shoe center section and coupled in a turnable manner to the upper shoe center section, and the upper shoe side section is configured so that an end on an outside of the upper shoe side section is turnable in a vertical direction about a coupling section with the upper shoe center section.

14. The tunnel excavation device according to claim 13, wherein the front body section further includes an upper shoe link section coupling the cutter head support section to the upper shoe and configured to move the upper shoe in a direction approaching the cutter head support section and in a direction away from the cutter head support section.

15. The tunnel excavation device according to claim 13, wherein the upper shoe center section includes an upper shoe center front section connected to the cutter head support section, and an upper shoe center rear section disposed on a rear side of the upper shoe center front section and coupled in a turnable manner to the upper shoe center front section, and the upper shoe center rear section is configured so that a rear end of the upper shoe center rear section is turnable in a vertical direction about a coupling section with the upper shoe center front section.

16. The tunnel excavation device according to claim 13, wherein the upper shoe side section includes an upper shoe side front section connected to upper shoe center section, and an upper shoe side rear section disposed on a rear side of the upper shoe side front section and coupled in a turnable manner to the upper shoe side front section, and the upper shoe side rear section is configured so that a rear end of the upper shoe side rear section is turnable in a vertical direction about a coupling section with the upper shoe side front section.

17. A tunnel excavation device comprising:

a front body section including a cutter head including a plurality of cutters, a cutter head support section supporting the cutter head, and a collapsing section provided to an outer circumference of the front body section, the collapsing section being configured to be collapsed toward an inside; and a rear body section including a gripper section for obtaining a reaction force when excavating, the rear body section being disposed to a rear of the front body section, the collapsing section including a lateral shoe disposed lateral to the cutter head support section, and the lateral shoe including a lateral shoe front section connected to the cutter head support section, and a lateral shoe rear section disposed on a rear side of the lateral shoe front section and coupled in a turnable manner to the lateral shoe front section, and the lateral shoe rear section being configured so that a rear end of the lateral shoe rear section is turnable in a horizontal direction about a coupling section with the lateral shoe front section.

18. The tunnel excavation device according to claim 17, wherein the front body section further includes a lateral shoe link section coupling the cutter head support section to the lateral shoe and configured to move the lateral shoe in a direction approaching the cutter head support section and in a direction away from the cutter head support section.

19. A tunnel excavation device comprising:

a front body section including a cutter head including a plurality of cutters, a cutter head support section supporting the cutter head, and a collapsing section provided to an outer circumference of the front body section, the collapsing section being configured to be collapsed toward an inside; and a rear body section including a gripper section for obtaining a reaction force when excavating, the rear body section being disposed to a rear of the front body section, the collapsing section including an upper shoe disposed above the cutter head support section, and the upper shoe including an upper shoe front section connected to the cutter head support section, and an upper shoe rear section disposed on a rear side of the upper shoe front section and coupled in a turnable manner to the upper shoe front section, and the upper shoe rear section being configured so that a rear end of the upper shoe rear section is turnable in a vertical direction about a coupling section with the upper shoe front section.

* * * * *